US010493595B2

(12) United States Patent
Deleuze et al.

(10) Patent No.: US 10,493,595 B2
(45) Date of Patent: Dec. 3, 2019

(54) ABRASIVE ARTICLES INCLUDING A COATING AND METHODS FOR FORMING THE SAME

(71) Applicants: SAINT-GOBAIN ABRASIVES, INC., Worcester, MA (US); SAINT-GOBAIN ABRASIFS, Conflans-Sainte-Honorine (FR)

(72) Inventors: Charles Deleuze, Boylston, MA (US); Dominique Billieres, Saint-Saturnin les Avignon (FR); Sethumadhavan Ravichandran, Hudson, MA (US); Ellis R. Cole, Hubbardston, MA (US); Remi J. Goulet, Sturbridge, MA (US); David M. Gebb, II, Worcester, MA (US); Eva Dieuzy, Allston, MA (US)

(73) Assignees: SAINT-GOBAIN ABRASIVES, INC., Worcester, MA (US); SAINT-GOBAIN ABRASIFS, Conflans-Sainte-Honorine (FR)

( * ) Notice: Subject to any disclaimer, the term of this patent is extended or adjusted under 35 U.S.C. 154(b) by 0 days.

(21) Appl. No.: 15/442,395

(22) Filed: Feb. 24, 2017

(65) Prior Publication Data

US 2017/0239787 A1 Aug. 24, 2017

Related U.S. Application Data

(60) Provisional application No. 62/299,145, filed on Feb. 24, 2016.

(51) Int. Cl.
*B24D 11/00* (2006.01)
*C23C 4/10* (2016.01)
(Continued)

(52) U.S. Cl.
CPC ..... *B24D 11/001* (2013.01); *C23C 4/10* (2013.01); *C23C 4/129* (2016.01); *C23C 4/134* (2016.01)

(58) Field of Classification Search
CPC ..... B24D 11/001; C23C 4/129; C23C 4/10
See application file for complete search history.

(56) References Cited

U.S. PATENT DOCUMENTS 2,036,903 A 4/1936 Webster
3,973,977 A * 8/1976 Wilson ..... C04B 35/44 501/120
(Continued)

FOREIGN PATENT DOCUMENTS

CN 104419889 A 3/2015
JP 2009196057 A 9/2009
(Continued)

OTHER PUBLICATIONS

International Search Report and Written Opinion dated May 10, 2017, with regard to International Application No. PCT/US2017/019481, 3 pgs.

*Primary Examiner* — Pegah Parvini
(74) *Attorney, Agent, or Firm* — Abel Schillinger, LLP; Alex H. Plache

(57) ABSTRACT

An abrasive article including a body including abrasive particles contained within a bond material, a first major surface, a second major surface, and a side surface extending between the first major surface and second major surface, and a coating overlying at least a portion of one of the first major surface or the second major surface. In an embodiment, the coating comprises at least one element selected from the group of chromium, nickel, carbon, nitrogen, tungsten, sulfur, molybdenum, iron, zinc, silicon, titanium, aluminum, zirconium, magnesium, zinc, boron, cobalt, cal-
(Continued)

cium, or any combination thereof. In another embodiment, the coating comprises a cermet, a ceramic, or a combination thereof.

20 Claims, 11 Drawing Sheets

(51) Int. Cl.
*C23C 4/129* (2016.01)
*C23C 4/134* (2016.01)

(56) References Cited

U.S. PATENT DOCUMENTS 4,157,898 A * 6/1979 Walker ..... C09K 3/1427 51/295
5,127,924 A 7/1992 Russell
5,580,833 A * 12/1996 Fu ..... C04B 35/5607 501/87
5,641,921 A * 6/1997 Dennis ..... B22F 3/105 148/206
5,942,015 A * 8/1999 Culler ..... B24D 3/28 51/295
6,004,362 A 12/1999 Seals et al.
6,238,280 B1 5/2001 Ritt et al.
7,063,608 B2 6/2006 Yoshida et al.
2002/0026752 A1 * 3/2002 Culler ..... B24D 3/28 51/298
2004/0185754 A1 * 9/2004 Adefris ..... B24B 1/00 451/28
2007/0020457 A1 1/2007 Adefris
2009/0145044 A1 * 6/2009 You ..... B24D 3/34 51/298
2009/0325466 A1 * 12/2009 Kincaid ..... B24D 3/20 451/28
2012/0055717 A1 * 3/2012 Liversage ..... E21B 10/56 175/428
2012/0114960 A1 * 5/2012 Takesawa ..... C22C 1/051 428/565
2013/0205676 A1 8/2013 Tian et al.
2013/0205678 A1 8/2013 Montross
2014/0378036 A1 * 12/2014 Cichowlas ..... B24D 5/12 451/533
2015/0291865 A1 10/2015 Breder et al.
2015/0291866 A1 10/2015 Arcona et al.
2015/0291867 A1 10/2015 Breder et al.

FOREIGN PATENT DOCUMENTS

JP 2012086304 A 5/2012
RU 2497652 C1 10/2013

* cited by examiner

ABRASIVE ARTICLES INCLUDING A COATING AND METHODS FOR FORMING THE SAME

CROSS-REFERENCE TO RELATED APPLICATION(S)

This application claims priority under 35 U.S.C. § 119(e) to U.S. Patent Application No. 62/299,145 entitled "ABRASIVE ARTICLES INCLUDING A COATING AND METHODS FOR FORMING THE SAME," by Charles Deleuze et al., filed Feb. 24, 2016, which is assigned to the current assignee hereof and incorporated herein by reference in its entirety.

BACKGROUND

Field of the Disclosure

The following is directed to abrasive articles, and particularly, bonded abrasive article including a coating.

Description of the Related Art

Abrasive tools, such as abrasive wheels are typically used for cutting, abrading, and shaping of various materials, such as stone, metal, glass, plastics, among other materials. Generally, the abrasive articles can have various phases of materials including abrasive grains, a bonding agent, and some porosity. Depending upon the intended application, the abrasive articles can have various designs, shapes, and configurations. For example, for applications directed to the finishing and cutting of metals, some abrasive wheels are fashioned such that they have a particularly thin profile for efficient cutting.

Abrasive tools are generally formed to have abrasive grains contained within a bond material for material removal applications. Various types of abrasive particles can be contained within the bond material, including for example, superabrasive grains (e.g., diamond or cubic boron nitride) or alumina abrasive grain. The bond material can be organic materials, such as a resin, or an inorganic material, such as a glass or vitrified material.

However, given the application of such wheels, the abrasive articles are subject to fatigue and failure. In fact, the wheels may have a limited time of use of less than a day depending upon the frequency of use. Accordingly, the industry continues to demand abrasive wheels capable of improved performance.

SUMMARY

According to first aspect, an abrasive article includes a body having abrasive particles contained within a bond material, a first major surface, a second major surface, and a side surface extending between the first major surface and second major surface, and a coating overlying at least a portion of one of the first major surface or the second major surface, wherein the coating comprises a cermet.

According to a second aspect, an abrasive article comprises a body including abrasive particles contained within a bond material, a first major surface, a second major surface, and a side surface extending between the first major surface and second major surface, and a coating overlying at least a portion of one of the first major surface or the second major surface, wherein the portion of the first major surface or second major surface including the coating comprises a surface roughness of at least 20 microns.

In another aspect, an abrasive article comprises a body including abrasive particles contained within a bond material, a first major surface, a second major surface, and a side surface extending between the first major surface and second major surface, and a coating overlying at least a portion of one of the first major surface or the second major surface, wherein a greater content of the coating overlies the abrasive particles compared to a content of coating overlying the bond material.

In yet another aspect, an abrasive article comprises a body including abrasive particles contained within a bond material, a first major surface, a second major surface, and a side surface extending between the first major surface and second major surface, and a coating overlying at least a portion of one of the first major surface or the second major surface, wherein the coating comprises at least one property selected from the group consisting of: a) a wear resistance of at least 0.15 mm3/6000 cycles in ASTM G65 test; b) a static coefficient of friction less than 0.8 (μs); c) a thermal conductivity of at least 10 W/m·K; d) a hardness of at least 550 (Vickers hardness scale); e) an emissivity less than 0.9; or any combination thereof.

According to one aspect, an abrasive article comprises a body including abrasive particles contained within a bond material, a first major surface, a second major surface, and a side surface extending between the first major surface and second major surface, and a coating overlying at least a portion of one of the first major surface or the second major surface, wherein the coating comprises at least one element selected from the group of chromium, nickel, carbon, nitrogen, tungsten, sulfur, molybdenum, iron, zinc, silicon, titanium, aluminum, zirconium, magnesium, zinc, boron, cobalt, calcium, or any combination thereof.

For another aspect, an abrasive article comprises a body including abrasive particles contained within a bond material, a first major surface, a second major surface, and a side surface extending between the first major surface and second major surface, and a coating overlying at least a portion of one of the first major surface or the second major surface, wherein the coating comprises a binder material and particles contained within the binder material, wherein the particles comprise a cermet, ceramic, or any combination thereof.

In yet another aspect, a method of making an abrasive article comprises applying a coating to at least one of a first major surface of a second major surface of a body, wherein the body includes abrasive particles contained within a bond material, and wherein the coating comprises at least one feature selected from the group consisting of: a) wherein the coating comprises a cermet; b) wherein the portion of the first major surface or second major surface including the coating comprises a surface roughness of at least 400 microns; c) wherein a greater content of the coating overlies the abrasive particles compared to a content of coating overlying the bond material; d) wherein the coating comprises a thermal conductivity of at least 10 W/m·K; or e) any combination of any of the features a-e; and further wherein the process of applying a coating is selected from the group consisting of: i) thermal spraying; ii) spray coating; iii) printing; iv) depositing; v) curing; vi) sintering or e) any combination of any of the processes i-vi.

BRIEF DESCRIPTION OF THE DRAWINGS

The present disclosure may be better understood, and its numerous features and advantages made apparent to those skilled in the art by referencing the accompanying drawings.

DETAILED DESCRIPTION

The following is directed to abrasive articles including bonded abrasive articles suitable for grinding various objects and types of workpieces. The abrasive articles are bonded abrasive tools including abrasive particles contained within a three-dimensional matrix of bond material for finishing, shaping, and/or conditioning workpieces. Certain embodiments herein are directed to bonded abrasive wheels. However, the features of the embodiments herein may be applicable to other abrasive technologies, including for example, coated abrasives and the like. Certain embodiments herein are directed to cut-off wheels incorporating one or more reinforcing members within the body of the tool. The bonded abrasive bodies may be distinct from other abrasive articles in that the body is essentially free of a substrate.

Figure 1:
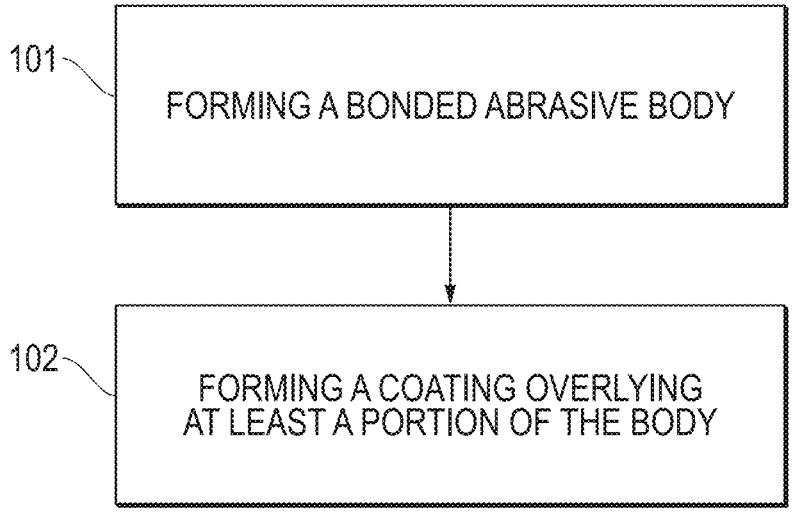
FIG. 1 includes a flow chart providing a process of forming an abrasive article according to an embodiment.

FIG. 1 includes a flowchart illustrating a process of forming an abrasive article in accordance with an embodiment. As illustrated, at step 101, the process can include forming a bonded abrasive article. The process of forming a bonded abrasive article can be started by formation of a mixture, which may include the components or precursor components to be part of the finally-formed bonded abrasive article. For example, the mixture can include abrasive particles, bond material or one or more precursors of the bond material, fillers, additives, reinforcing materials, and the like.

In one embodiment, the abrasive particles can include materials such as oxides, carbides, nitrides, borides, carbon-based materials (e.g., diamond), oxycarbides, oxynitrides, oxyborides, and a combination thereof. According to one embodiment, the abrasive particles can include a superabrasive material. The abrasive particles can include a material selected from the group of silicon dioxide, silicon carbide, alumina, zirconia, flint, garnet, emery, rare earth oxides, rare earth-containing materials, cerium oxide, sol-gel derived particles, gypsum, iron oxide, glass-containing particles, and a combination thereof. In another instance, abrasive particles may also include silicon carbide (e.g., Green 39C and Black 37C), brown fused alumina (57A), seeded gel abrasive, sintered alumina with additives, shaped and sintered aluminum oxide, pink alumina, ruby alumina (e.g., 25A and 86A), electrofused monocrystalline alumina 32A, MA88, alumina zirconia abrasives (e.g., NZ, NV, ZF Brand from Saint-Gobain Corporation), extruded bauxite, sintered bauxite, cubic boron nitride, diamond, aluminum oxy-nitride, sintered alumina (e.g., Treibacher's CCCSK), extruded alumina (e.g., SR1, TG, and TGII available from Saint-Gobain Corporation), or any combination thereof. According to one particular embodiment, the abrasive particles consist essentially of silicon carbide. The abrasive particles can have a Mohs hardness or at least 7, such as at least 8, or even at least 9.

The abrasive particles may have other particular features. For example, the abrasive particles may have an elongated shaped. In particular instances, the abrasive particles may have an aspect ratio, defined as a ratio of the length:width of at least about 1:1, wherein the length is the longest dimension of the particle and the width is the second longest dimension of the particle (or diameter) perpendicular to the dimension of the length. In other embodiments, the aspect ratio of the abrasive particles can be at least about 2:1, such as at least about 2.5:1, at least about 3:1, at least about 4:1, at least about 5:1, or even at least about 10:1. In one non-limiting embodiment, the abrasive particles may have an aspect ratio of not greater than about 5000:1.

According to at least one embodiment, at least a portion of the abrasive particles may include shaped abrasive particles as disclosed for example, in US 20150291865, US 20150291866, and US 20150291867. Shaped abrasive particles are formed such that each particle has substantially the same arrangement of surfaces and edges relative to each other for shaped abrasive particles having the same two-dimensional and three-dimensional shapes. As such, shaped abrasive particles can have a high shape fidelity and consistency in the arrangement of the surfaces and edges relative to other shaped abrasive particles of the group having the same two-dimensional and three-dimensional shape. By contrast, non-shaped abrasive particles can be formed through different process and have different shape attributes. For example, non-shaped abrasive particles are typically formed by a comminution process, wherein a mass of material is formed and then crushed and sieved to obtain abrasive particles of a certain size. However, a non-shaped abrasive particle will have a generally random arrangement of the surfaces and edges, and generally will lack any recognizable two-dimensional or three dimensional shape in the arrangement of the surfaces and edges around the body. Moreover, non-shaped abrasive particles of the same group or batch generally lack a consistent shape with respect to each other, such that the surfaces and edges are randomly arranged when compared to each other. Therefore, non-shaped grains or crushed grains have a significantly lower shape fidelity compared to shaped abrasive particles.

In accordance with one aspect of the embodiments herein, the mixture and the resulting fixed abrasive article can include a blend of abrasive particles. The blend of abrasive particles can include a first type of abrasive particle and a second type of abrasive particle, which is distinct from the first type of abrasive particle in at least one aspect, such as particle size, grain size, composition, shape, hardness, friability, toughness, and the like. For example, in one embodiment, the first type of abrasive particle can include a premium abrasive particle (e.g., fused alumina, alumina-zirconia, seeded sol gel alumina, shaped abrasive particle, etc.) and the second type of abrasive particle can include a diluent abrasive particle.

The blend of abrasive particles can include a first type of abrasive particle present in a first content (C1), which may be expressed as a percentage (e.g., a weight percent) of the first type of abrasive particles as compared to the total content of particles of the blend. Furthermore, the blend of abrasive particles may include a second content (C2) of the second type of abrasive particles, expressed as a percentage (e.g., a weight percent) of the second type of abrasive particles relative to the total weight of the blend. The first content can be the same as or different from the second content. For example, in certain instances, the blend can be formed such that the first content (C1) can be not greater than 90% of the total content of the blend. In another embodiment, the first content may be less, such as not greater than 85%, not greater than 80%, not greater than 75%, not greater than 70%, not greater than 65%, not greater than 60%, not greater than 55%, not greater than 50%, not greater than 45%, not greater than 40%, not greater than 35%, not greater than 30%, not greater than 25%, not greater than 20%, not greater than 15%, not greater than 10%, or even not greater than 5%. Still, in one non-limiting embodiment, the first content of the first type of abrasive particles may be present in at least 1% of the total content of abrasive particles of the blend. In yet other instances, the first content (C1) may be at least 5%, such as at least 10%, at least 15%, at least 20%, at least 25%, at least 30%, at least 35%, at least 40%, at least 45%, at least 50%, at least 55%, at least 60%, at least 65%, at least 70%, at least 75%, at least 80%, at least 85%, at least 90%, or even at least 95%. It will be appreciated that the first content (C1) may be present within a range between any of the minimum and maximum percentages noted above.

The blend of abrasive particles may include a particular content of the second type of abrasive particle. For example, the second content (C2) may be not greater than 98% of the total content of the blend. In other embodiments, the second content may be not greater than 95%, such as not greater than 90%, not greater than 85%, not greater than 80%, not greater than 75%, not greater than 70%, not greater than 65%, not greater than 60%, not greater than 55%, not greater than 50%, not greater than 45%, not greater than 40%, not greater than 35%, not greater than 30%, not greater than 25%, not greater than 20%, not greater than 15%, not greater than 10%, or even not greater than 5%. Still, in one non-limiting embodiment, the second content (C2) may be present in an amount of at least about 1% of the total content of the blend. For example, the second content may be at least 5%, such as at least 10%, at least 15%, at least 20%, at least 25%, at least 30%, at least 35%, at least 40%, at least 45%, at least 50%, at least 55%, at least 60%, at least 65%, at least 70%, at least 75%, at least 80%, at least 85%, at least 90%, or even at least 95%. It will be appreciated that the second content (C2) can be within a range between any of the minimum and maximum percentages noted above.

In accordance with another embodiment, the blend of abrasive particles may have a blend ratio (C1/C2) that may define a ratio between the first content (C1) and the second content (C2). For example, in one embodiment, the blend ratio (C1/C2) may be not greater than 10. In yet another embodiment, the blend ratio (C1/C2) may be not greater than 8, such as not greater than 6, not greater than 5, not greater than 4, not greater than 3, not greater than 2, not greater than 1.8, not greater than 1.5, not greater than 1.2, not greater than 1, not greater than 0.9, not greater than 0.8, not greater than 0.7, not greater than 0.6, not greater than 0.5, not greater than 0.4, not greater than 0.3, or even not greater than 0.2. Still, in another non-limiting embodiment, the blend ratio (C1/C2) may be at least 0.1, such as at least 0.15, at least 0.2, at least 0.22, at least 0.25, at least 0.28, at least 0.3, at least 0.32, at least 0.3, at least 0.4, at least 0.45, at least 0.5, at least 0.55, at least 0.6, at least 0.65, at least 0.7, at least 0.75, at least 0.8, at least 0.9, at least 0.95, at least 1, at least 1.5, at least 2, at least 3, at least 4, or even at least 5. It will be appreciated that the blend ratio (C1/C2) may be within a range between any of the minimum and maximum values noted above.

In other non-limiting embodiments, the blend may include other types of abrasive particles. For example, the blend may include a third type of abrasive particle that may include a conventional abrasive particle or a shaped abrasive particle. The third type of abrasive particle may include a diluent type of abrasive particle having an irregular shape, which may be achieved through conventional crushing and comminution techniques.

In at least one embodiment, the abrasive particles can include crystalline grains, and may consist entirely of a polycrystalline material made of crystalline grains. In particular instances, the abrasive particles can include crystalline grains having a median grain size of not greater than 1.2 microns. In other instances, the median grain size can be not greater than 1 micron, such as not greater than 0.9 microns or not greater than 0.8 microns or even not greater than 0.7 microns. According to one non-limiting embodiment, the median grain size of the abrasive particles can be at least 0.01 microns, such as at least 0.05 microns or at least 0.1 microns or at least 0.2 microns or even at least 0.4 microns. It will be appreciated that the median grain size of the abrasive particles can be within a range between any of the minimum and maximum values noted above. The median grain size is measured by an uncorrected intercept method by SEM micrographs.

The abrasive particles may have a particular average particle size. For example, the abrasive particles may have an average particle size of not greater than 3 mm, such as not greater than 2 mm or not greater than 1 mm or not greater than 900 microns or not greater than 800 microns or not greater than 700 microns or even not greater than 600 microns. According to one non-limiting embodiment, the average particle size of the abrasive particles can be at least 100 microns, such as at least 200 microns or at least 300 microns or at least 400 microns or at least 500 microns or at least 600 microns or at least 700 microns or at least 800 microns or at least 900 microns or at least 1 mm or at least 1.2 mm or at least 1.5 mm or at least 2 mm. It will be appreciated that the average particle size of the abrasive particles can be within a range including any of the minimum and maximum values noted above.

As described herein, in addition to the abrasive particles, the mixture may also include other components or precursors to facilitate formation of the abrasive article. For example, the mixture may include a bond material or a precursor of the bond material. According to one embodiment, the bond material may include a material selected from the group consisting of an organic material, an organic precursor material, an inorganic material, an inorganic precursor material, a natural material, and a combination thereof. In particular instances, the bond material may include a metal or metal alloy, such as a powder metal material, or a precursor to a metal material, suitable for formation of a metal bond matrix material during further processing.

According to another embodiment, the mixture may include a vitreous material, or a precursor of a vitreous material, suitable for formation of a vitreous bond material during further processing. For example, the mixture may include a vitreous material in the form of a powder, including for example, an oxygen-containing material, an oxide compound or complex, a frit, and any combination thereof.

In yet another embodiment, the mixture may include a ceramic material, or a precursor of a ceramic material, suitable for formation of a ceramic bond material during further processing. For example, the mixture may include a ceramic material in the form of a powder, including for example, an oxygen-containing material, an oxide compound or complex, and any combination thereof.

According to another embodiment, the mixture may include an organic material, or a precursor of an organic material, suitable for formation of an organic bond material during further processing. Such an organic material may include one or more natural organic materials, synthetic organic materials, and a combination thereof. In particular instances, the organic material can be made of a resin, which may include a thermoset, a thermoplastic, and a combination thereof. For example, some suitable resins can include phenolics, epoxies, polyesters, cyanate esters, shellacs, polyurethanes, polybenzoxazines, polybismaleimides, polyimides, rubber, and a combination thereof. In one particular embodiment, the mixture includes an uncured resin material configured to form a phenolic resin bond material through further processing.

The phenolic resin may be modified with a curing or cross-linking agent, such as hexamethylene tetramine. At temperatures in excess of about 90° C., some examples of the hexamethylene tetramine may form crosslinks to form methylene and dimethylene amino bridges that help cure the resin. The hexamethylene tetramine may be uniformly dispersed within the resin. More particularly, hexamethylene tetramine may be uniformly dispersed within resin regions as a cross-linking agent. Even more particularly, the phenolic resin may contain resin regions with cross-linked domains having a sub-micron average size.

Other materials, such as a filler, can be included in the mixture. The filler may or may not be present in the finally-formed abrasive article. The filler may include a material selected from the group consisting of powders, granules, spheres, fibers, and a combination thereof. Moreover, in particular instances, the filler can include an inorganic material, an organic material, fibers, woven materials, non-woven materials, particles, minerals, nuts, shells, oxides, alumina, carbide, nitrides, borides, polymeric materials, naturally occurring materials, and a combination thereof. In a certain embodiment, the filler can include a material such as sand, bubble alumina, chromites, magnesite, dolomites, bubble mullite, borides, titanium dioxide, carbon products (e.g., carbon black, coke or graphite), silicon carbide, wood flour, clay, talc, hexagonal boron nitride, molybdenum disulfide, feldspar, nepheline syenite, glass spheres, glass fibers, $CaF_2$, $KBF_4$, Cryolite ($Na_3AlF_6$), potassium Cryolite ($K_3AlF_6$), pyrites, ZnS, copper sulfide, mineral oil, fluorides, carbonates, calcium carbonate, wollastonite, mullite, steel, iron, copper, brass, bronze, tin, aluminum, kyanite, alusite, garnet, quartz, fluoride, mica, nepheline syenite, sulfates (e.g., barium sulfate), carbonates (e.g., calcium carbonate), titanates (e.g., potassium titanate fibers), rock wool, clay, sepiolite, iron sulfide (e.g., $Fe_2S_3$, $FeS_2$, or a combination thereof), potassium fluoroborate ($KBF_4$), zinc borate, borax, boric acid, fine alundum powders, P15A, cork, glass spheres, silica microspheres (Z-light), silver, Saran™ resin, paradichlorobenzene, oxalic acid, alkali halides, organic halides, attapulgite or any combination thereof.

In at least one embodiment, the filler may include a material selected from the group consisting of an antistatic agent, a lubricant, a porosity inducer, coloring agent, and a combination thereof. In particular instances wherein the filler is particulate material, it may be distinct from the abrasive particles, being significantly smaller in average particle size than the abrasive particles.

After forming the mixture the process of forming the abrasive article can further include forming a green body comprising abrasive particles contained in a bond material. A green body is a body that is unfinished and may undergo further processing before a finally-formed abrasive article is formed. Forming of the green body can include techniques such as pressing, molding, casting, printing, spraying, and a combination thereof. In one particular embodiment, forming of the green body can include pressing the mixture into a particular shape, including for example, conducting a pressing operation to form a green body in the form of a grinding wheel.

It will also be appreciated that one or more reinforcing materials may be included within the mixture, or between portions of the mixture to create a composite body including one or more abrasive portions (i.e., abrasive particles contained within the bond material as well as porosity, fillers and the like) and reinforcing portions made up of the reinforcing materials. Some suitable examples of reinforcing materials include woven materials, non-woven materials, fiberglass, fibers, naturally occurring materials, synthetic materials, inorganic materials, organic materials, or any combination thereof. As used herein, terms such as "reinforced" or "reinforcement" refer to discrete layers or portions of a reinforcing material that is different from the bond and abrasive materials employed to make the abrasive portions. Terms such as "internal reinforcement" or "internally reinforced" indicate that these components are within or embedded in the body of the abrasive article. In cut-off wheels the internal reinforcement can be, for example, in the shape of a disc with a middle opening to accommodate the arbor hole of the wheel. In some wheels, the reinforcing materials extend from the arbor hole to the periphery of the body. In others, reinforcing materials can extend from the periphery of the body to a point just under the flanges used to secure the body. Some abrasive articles may be "zone reinforced" with (internal) fiber reinforcement around the arbor hole and flange areas of the body (about 50% of the diameter of the body).

After forming the mixture with the desired components and applying the mixture in the desired processing apparatus, the process can continue by treating the mixture to form a finally-formed abrasive article. Some suitable examples of treating can include curing, heating, sintering, crystallizing, polymerization, pressing, and a combination thereof. In one example, the process may include bond batching, mixing abrasive particles with bond or bond precursor materials, filling a mold, pressing, and heating or curing the mixture.

Figure 2:
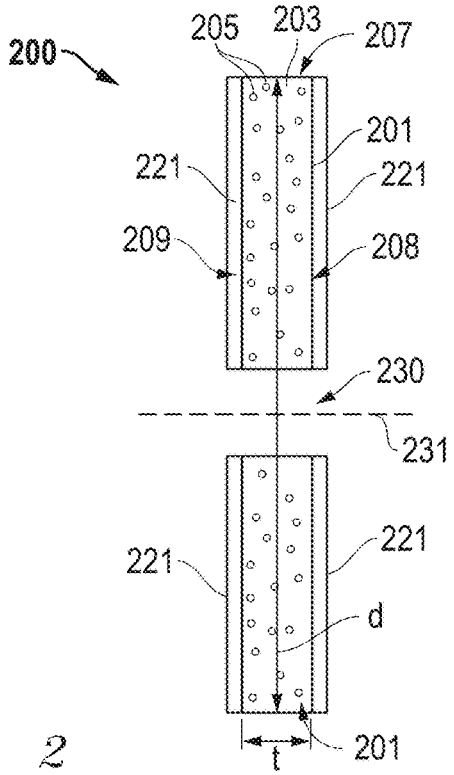
FIG. 2 includes a cross-sectional image of a portion of an abrasive article according to an embodiment.

After finishing the treating process, the abrasive article is formed including abrasive particles and any other additives contained within a three-dimensional matrix of the bond material. FIG. 2 includes cross-sectional illustration of a bonded abrasive article including a coating according to an embodiment. The abrasive article 200 includes a body 201 including a central opening 230 and an axial axis 231 extending through the central opening in the axial direction, which can be perpendicular to a radial axis extending along a direction defining the diameter (d) of the body. The body 201 further includes abrasive particles 205 contained within a three-dimensional matrix of the bond material 203. It will be appreciated that any other fillers and/or phases (e.g., porosity) of the body can be contained within the bond material 203. In at least one embodiment, the bond material 203 defines an interconnected and continuous phase throughout the entire volume of the body 201.

The body 201 can include a particular content of bond material 203. For example, the body 201 can have at least 30 vol % bond material 203 for the total volume of the body 201. In other instances, the content of bond material 203 in the body 201 can be greater, such as at least 35 vol % or at least 40 vol % or at least 45 vol % or at least 50 vol % or at least 55 vol % or at least 60 vol % or even at least 65 vol %. Still, in at least one non-limiting embodiment, the content of bond material 203 in the body 201 can be not greater than 70 vol %, such as not greater than 65 vol % or not greater than 60 vol % or not greater than 55 vol % or not greater than 50 vol % or not greater than 45 vol % or not greater than 40 vol % or even not greater than 35 vol %. It will be appreciated that the content of bond material 203 in the body 201 can be within a range between any of the minimum and maximum percentages noted above, including for example, but not limited to within a range including at least 30 vol % and not greater than 65 vol %.

According to one embodiment, the body 201 can have a particular content of porosity. For example, the body 201 can have not greater than 40 vol % porosity for the total volume of the body. In a particular instance, the body 201 can have not greater than 35 vol %, such as not greater than 30 vol % or not greater than 25 vol % or not greater than 20 vol % or not greater than 15 vol % or not greater than 10 vol % or not greater than 8 vol % or not greater than 5 vol % or not greater than 4 vol % or even not greater than 3 vol % porosity. For at least one embodiment, the body 201 can have no porosity. According to one non-limiting embodiment, the body 201 can have at least 0.05 vol % porosity for the total volume of the body 201, such as at least 0.5 vol % porosity or at least 1 vol % or at least 2 vol % or at least 3 vol % or at least 5 vol % or at least 10 vol % or at least 15 vol % or at least 20 vol % or even at least 30 vol %. It will be appreciated that the porosity of the body 201 can be within a range between any of the minimum and maximum percentages noted above, including for example, but not limited to a content within a range of at least 0.5 vol % and not greater than 30 vol %.

The porosity may be closed porosity defined by discrete pores. In certain instances, the porosity may also be open porosity defining a network of interconnected channels extending through at least a portion of the body. Still, in other instances, the porosity may be a combination of closed and open porosity.

The body 201 may be formed to have a particular content of abrasive particles 205. For example, in one embodiment, the body 201 can include at least 30 vol % abrasive particles 205 for the total volume of the body 201, such as at least 35 vol % or at least 40 vol % or at least 45 vol % or at least 50 vol % or at least 55 vol % or at least 60 vol % abrasive particles. In at least one non-limiting embodiment, the body 201 can have a content of abrasive particles 205 of not greater than 65 vol %, such as not greater than 60 vol % or not greater than 55 vol % or not greater than 50 vol % or not greater than 45 vol % or not greater than 40 vol % or even not greater than 35 vol %. It will be appreciated that the content of abrasive particles 205 in the body 201 can be within a range including any of the minimum and maximum percentages noted above, including for example, but not limited to, within a range of at least 30 vol % and not greater than 60 vol %.

It will be appreciated that the body 201 can include certain additives, such as fillers as noted herein (e.g., active fillers, grinding aids, pore formers, mixing aids, reinforcing agents, etc.). The body 201 can include a particular content of the additives, including for example, a minority content of the additives for the total volume of the body. For example, the body 201 can have not greater than 40 vol % additives for the total volume of the body. In a particular instance, the body 201 can have not greater than 35 vol %, such as not greater than 30 vol % or not greater than 25 vol % or not greater than 20 vol % or not greater than 15 vol % or not greater than 10 vol % or not greater than 8 vol % or not greater than 5 vol % or not greater than 4 vol % or even not greater than 3 vol % additives. For at least one embodiment, the body 201 can have no additives. According to one non-limiting embodiment, the body 201 can have at least 0.05 vol % additives for the total volume of the body 201, such as at least 0.5 vol % or at least 1 vol % or at least 2 vol % or at least 3 vol % or at least 5 vol % or at least 10 vol % or at least 15 vol % or at least 20 vol % or even at least 30 vol % additives. It will be appreciated that the additives within the body 201 can be within a range between any of the minimum and maximum percentages noted above, including for example, but not limited to a content within a range of at least 0.5 vol % and not greater than 30 vol %.

The body 201 is illustrated in cross-section as having a generally rectangular shape, which may be representative of a wheel or disc shape with a central opening 230, such that it is an annulus. It will be appreciated that the abrasive articles of the embodiments herein can have a body that may be in the form of a hone, a cone, a cup, flanged shapes, a cylinder, a wheel, a ring, and a combination thereof.

The body 201 can have a generally circular shape as viewed top down. It will be appreciated, that in three-dimensions the body 201 can have a certain thickness (t) such that the body 201 has a disk-like or a cylindrical shape. As illustrated, the body 201 can have an outer diameter (d) extending through the center of the body 201. The central opening 230 can extend through the entire thickness (t) of the body 201 such that the abrasive article 200 can be mounted on a spindle or other machine for rotation of the abrasive article 200 during operation. According to one embodiment, the body 201 may have a particular relationship between the thickness (t) and the diameter (D), such that an aspect ratio (D:t) of the body is at least 10:1, such as at least 20:1 or at least 30:1 or at least 40:1 or at least 50:1 or at least 60:1 or at least 70:1 or at least 80:1 or at least 90:1 or at least 100:1. Still, in one non-limiting embodiment, the aspect ratio (D:t) may be not greater than 1000:1 or not greater than 500:1. It will be appreciated that the aspect ratio (D:t) can be within a range including any of the minimum and maximum values noted above.

Referring again to FIG. 1, after forming the bonded abrasive, the process can continue at step 102, which can include forming a coating overlying at least a portion of the body. Certain processes suitable for forming the coating can include depositing, dip coating, printing, pressing, spraying, heating, curing, and a combination thereof.

In at least one embodiment, the coating can be applied by a thermal spraying process. This family of processes includes for instance: HVOF (High Velocity Oxy-fuel), HVAF (High-Velocity Air Fuel), cold spraying, plasma spraying (APS), wire or flexicord flame spraying, and the like. The process may be determined in part based upon the material to be sprayed. According to one particular process, the thermal spraying process can include a liquid-fuel HVOF process, wherein the material to be coated, which is originally in the form of a solid powder, is directed at high speeds through a flame of sufficient temperature to create a molten or semi-molten material from the powder material. The molten and/or semi-molten material is projected from the end of a gun and applied to a target area of a workpiece. The deposited material can create a sufficiently dense, adherent coating. Various parameters such as nozzle reference, oxygen flow rate, kerosene (or other combustible source material) flow rate, spraying distance, powder feed rate, linear relative speed, and number of passes can be controlled to control the characteristics of the coating.

According to one embodiment, the nozzle reference can be a 200/11 type nozzle.

According to another embodiment, the oxygen flow rate can be at least 200 l/min, such as at least 400 l/min or at least 500 l/min or at least 600 l/min or at least 700 l/min or at least 800 l/min or at least 900 l/min. Still, in another non-limiting embodiment, the oxygen flow rate can be not greater than 3000/l/min, such as not greater than 2500/l/min or not greater than 2000 l/min or not greater than 1500 l/min or not greater than 1200 l/min. It will be appreciated that the oxygen flow rate can be within a range including any of the minimum and maximum values noted above.

In yet another embodiment, the process may use a flow rate of combustible material (e.g., a hydrocarbon containing material, and more particularly, kerosene) of at least 10 l/min, such as at least 12 l/min or at least 14 l/min or at least 16 l/min or at least 18 l/min or at least 20 l/min or at least 24 l/min. Still, in another non-limiting embodiment, the flow rate of the combustible material can be not greater than 40/l/min, such as not greater than 35/l/min or not greater than 32 l/min or not greater than 30 l/min or not greater than 28 l/min. It will be appreciated that the flow rate can be within a range including any of the minimum and maximum values noted above.

The spraying distance may be measured as the shortest linear distance from the end of the gun from which the molten or semi-molten material is ejected and the surface of the target. According to one embodiment, the spraying distance can be not greater than 1000 mm, such as not greater than 900 mm or not greater than 800 mm or not greater than 600 mm or not greater than 500 mm or even not greater than 400 mm. Still, in at least one embodiment, the spraying distance can be at least 100 mm, such as at least 200 mm or at least 300 mm or even at least 375 mm. It will be appreciated that the spraying distance can be within a range including any of the minimum and maximum values noted above.

For at least one embodiment, the powder feed rate may be not greater than 1000 g/min, such as not greater than 900 g/min or not greater than 800 g/min or not greater than 600 g/min or not greater than 500 g/min or not greater than 400 g/min or not greater than 300 g/min or not greater than 200 g/min or not greater than 100 g/min. Still, in at least one embodiment, the powder feed rate can be at least 10 g/min, such as at least 20 g/min or at least 40 g/min or even at least 60 g/min or at least 80 g/min or at least 90 g/min. It will be appreciated that the powder feed rate can be within a range including any of the minimum and maximum values noted above.

In another aspect, the linear relative speed, which defines the linear speed at which the gun translates across the target area, can be not greater than 15 m/s, such as not greater than 12 m/s or not greater than 10 m/s or not greater than 8 m/s or not greater than 5 m/s or not greater than 4 m/s or not greater than 3 m/s or not greater than 2 m/s or not greater than 1 m/s. Still, in at least one embodiment, the linear relative speed can be at least 0.1 m/s, such as at least 0.2 m/s or at least 0.4 m/s or even at least 0.6 m/s or at least 0.8 m/s or at least 0.9 m/s. It will be appreciated that the linear relative speed can be within a range including any of the minimum and maximum values noted above.

It will also be appreciated that the number of passes of the gun over the target area may be controlled to facilitate suitable formation of the layer having the characteristics of the embodiments herein. In at least one embodiment, the number of passes can be at least 10 passes, such as at least 15 passes or at least 20 passes or at least 25 passes or at least 30 passes. In one non-limiting embodiment, the number of passes of the gun over the target area can be not greater than 100 passes or not greater than 80 passes or not greater than 60 passes or not greater than 40 passes. It will be appreciated that the number of passes can be within a range including any of the minimum and maximum values noted above.

In yet another embodiment, the coating can include a process of spray coating, which does not necessarily need to include a thermal spraying process. Instead, the spray coating process can include the application of liquid-form (e.g., a slurry) of the material to be deposited on the material. For example, the spray coating process can include ejecting droplets of a liquid containing the material to be deposited at the target. Spray coating can include deposition of a liquid phase of the coating material or a liquid phase of a precursor material of the coating material. After applying the coating material to at least a portion of a surface of the body of the bonded abrasive, the coating material can be further processed to form the finally-formed coating overlying at least a portion of a surface of the body. Some exemplary processes can include heating, drying, curing, irradiating, solidifying, cooling, and the like. In certain processes, volatilization may take place, which may affect the final contents of the coating components.

According to one particular embodiment, the coating can overly at least a portion of a major surface of the body. For example, referring to FIG. 2, the body 201 can include a first major surface 208, a second major surface 209 opposite the first major surface and separated from the first major surface 208 by a side surface 207. As illustrated in the embodiment, of FIG. 2, the abrasive article 200 can include a coating 221 overlying the first major surface 208. The coating 221 can be bonded directly to the first major surface 208, such that there are no intervening layers between the coating 221 and the first major surface 208. In at least one embodiment, the coating 221 can extend from the central opening 230 to the outer peripheral edge of the body 201 defined by the side surface 207.

As further illustrated in FIG. 2, the coating 221 can overly the second major surface 209. The coating 221 can be bonded directly to the second major surface 209, such that there are no intervening layers between the coating 221 and the second major surface 209. In at least one embodiment, the coating 221 on the second major surface 209 can extend from the central opening 230 to the outer peripheral edge of the body 201 defined by the side surface 207.

Figures 3A, 3B, 3C, 3D:
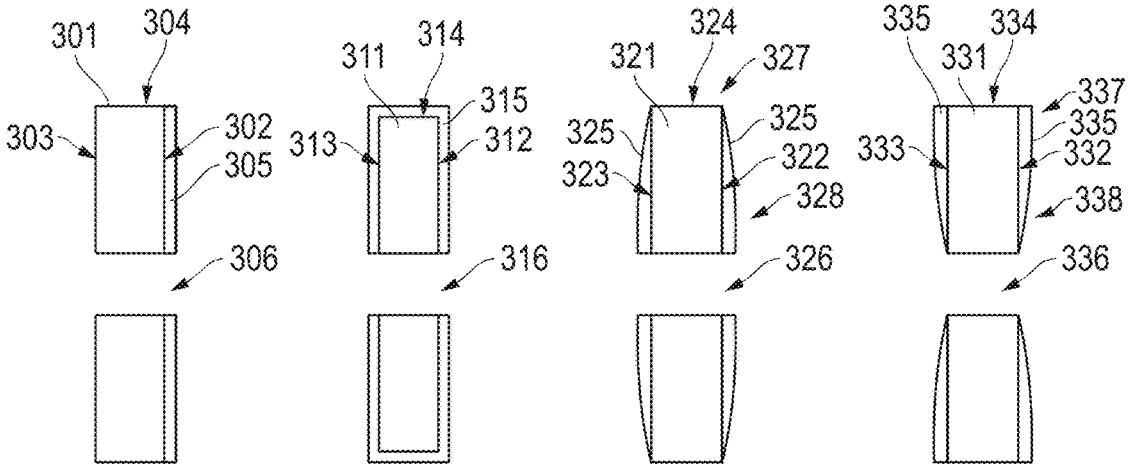
FIGS. 3A-3E include cross-sectional images of abrasive articles according to embodiments.

FIGS. 3A-3E include cross-sectional illustrations of abrasive articles including bonded abrasive bodies and a coating overlying at least a portion of a surface of the body. Notably, FIGS. 3A-3E provide illustrations of various arrangements of coatings on bonded abrasive bodies according to embodiments herein. In FIG. 3A, the bonded abrasive body 301 includes a first major surface 302, a second major surface 303, and a side surface 304 extending between the first major surface 302 and the second major surface 303. The coating 305 is overlying the first major surface 302, but the second major surface 303 and the side surface 304 are exposed, such that the coating 305 is not overlying the second major surface 303 and side surface 304. The coating 305 can extend from the central opening 306 to the outer peripheral edge of the body 301 defined by the side surface 304. It will be appreciated that the coating 305 may also extend circumferentially around the first major surface 302, such that essentially all of the first major surface 302 is covered by the coating 305.

In FIG. 3B, the bonded abrasive body 311 includes a first major surface 312, a second major surface 313, and a side surface 314 extending between the first major surface 312 and the second major surface 313. The coating 315 is overlying the first major surface 312, the second major surface 313 and the side surface 314. As illustrated, the coating 315 can extend from the central opening 316 to the outer peripheral edge of the body 311 defined by the side surface 314, and further extend axially and circumferentially around the side surface 314, such that essentially all of the entire exterior surface (except the inner surface of the central opening 316) is covered by the coating 315.

In FIG. 3C, the bonded abrasive body 321 includes a first major surface 322, a second major surface 323, and a side surface 324 extending between the first major surface 322 and the second major surface 323. The coating 325 is overlying the first major surface 322 and the second major surface 323. The side surface 324 is exposed, such that the coating is not overlying the side surface 324. As illustrated, the coating 325 can extend from the central opening 326 to the outer peripheral edge of the body 321 defined by the side surface 324. Moreover, in the illustrated embodiment, the coating 325 can have a thickness that varies with the radial position along the body 321. For example, the thickness of the coating 325 within a first radial region 327 adjacent to the edge of the side surface 324 and the first major surface 322 (or second major surface 323) can be different than the thickness of the coating 325 in a second radial region 328 that is closer to the central opening 326 relative to the first radial region 327. More particularly, the thickness of the coating 325 in the first radial region 327 can be less than the thickness of the coating 325 in the second radial region 328. The thickness of the coating can change gradually or in discrete intervals, such as a stepped configuration.

FIG. 3D illustrates a bonded abrasive body 331 including a first major surface 332, a second major surface 333, and a side surface 334 extending between the first major surface 332 and the second major surface 333. The coating 335 is overlying the first major surface 332 and the second major surface 333. The side surface 334 is exposed, such that the coating is not overlying the side surface 334. As illustrated, the coating 335 can extend from the central opening 336 to the outer peripheral edge of the body 331 defined by the side surface 334. Moreover, in the illustrated embodiment, the coating 335 can have a thickness that varies with the radial position along the body 331. For example, the thickness of the coating 335 within a first radial region 337 adjacent to the edge of the side surface 334 and the first major surface 332 (or second major surface 333) can be different than the thickness of the coating 335 in a second radial region 338 that is closer to the central opening 336 relative to the first radial region 337. More particularly, the thickness of the coating 335 in the first radial region 337 can be greater than the thickness of the coating 335 in the second radial region 338. The thickness of the coating can change gradually or in discrete intervals, such as a stepped configuration.

Figure 3E:
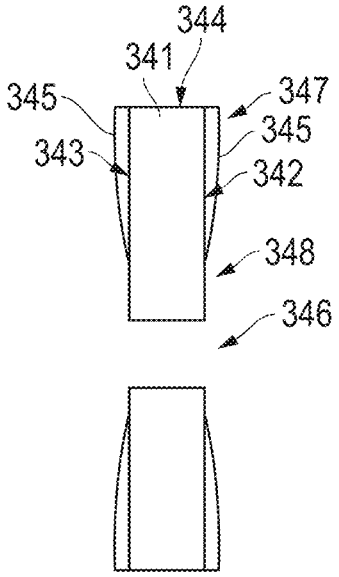

In FIG. 3E, the bonded abrasive body 341 includes a first major surface 342, a second major surface 343, and a side surface 344 extending between the first major surface 342 and the second major surface 343. The coating 345 is overlying a portion of the first major surface 342 and a portion of the second major surface 343. The side surface 344 is exposed, such that the coating is not overlying the side surface 344. As further illustrated, the coating 345 can overlie the first major surface 342 and the second major surface 343 in the first radial region 347 adjacent to the edge of the side surface 344 and the first major surface 342 (or second major surface 343). Accordingly, the coating 345 can extend circumferentially through the first radial region 347, such that the coating 345 defines an annular region on the first and second major surfaces 342 and 343. As further illustrated, the first major surface 342 and second major surface 343 can have exposed portions, including for example, in a second radial region 348 that is closer to the central opening 346 relative to the first radial region 347. That is, the coating is not overlying the first major surface 342 and second major surface 343 in the second radial region 348.

It will be appreciated that other variations on the coating arrangement may be utilized and are within the scope of the embodiments herein. Notably, various arrangements of the coating may be utilized, including for example, but not limited to, a coating that is patterned on at least a portion of a surface of the body and defines covered regions and exposed regions of the underlying bonded abrasive body. Likewise, various coating thicknesses may be applied selectively to certain regions of the bonded abrasive body.

In at least one embodiment, the coating is applied to limit the wear of the body during material removal operations. The wear of the body and generation of heat, particularly at the side surfaces of the body, has demonstrated to limit the useful life of the abrasive article. The coating may limit wear, increase lubricity, and limit the generation of excessive heat at the side surface of the body during grinding, which may facilitate improved performance of the abrasive article.

The coating may have an average thickness (tc) of the coating that may be controlled to provide suitable wear-resistant properties while also not negatively impacting the material removal operations. As noted and illustrated herein, the coating can have a thickness that is substantially the same across a radial axis of the body. In other embodiments, the thickness of the coating can be substantially different across the radial axis of the body (see, for example, embodiments of FIGS. 3C-3E).

Figure 4:
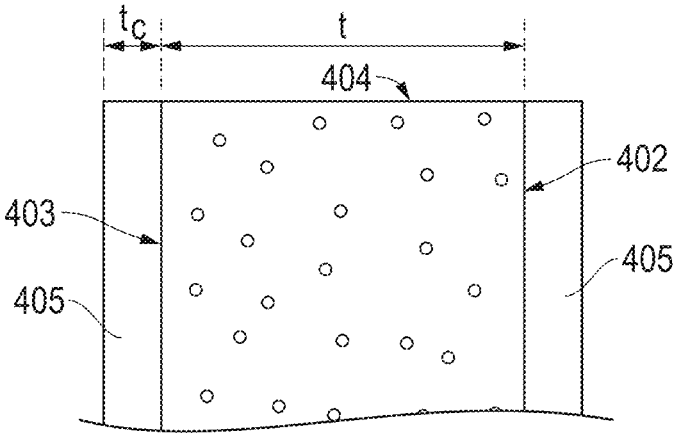
FIG. 4 includes a cross-sectional illustration of a portion of an abrasive article including a bonded abrasive body and a coating according to an embodiment FIG. 5 includes a cross-sectional image of a portion of an abrasive article according to an embodiment.

FIG. 4 includes a cross-sectional illustration of a portion of an abrasive article including a bonded abrasive body and a coating according to an embodiment. As illustrated, the bonded abrasive body 401 includes a first major surface 402, a second major surface 403, and a side surface 404 extending between the first major surface 402 and the second major surface 403. The coating 405 is overlying at least a portion of the first major surface 402 and a portion of the second major surface 403. The side surface 404 is exposed, such that the coating 405 is not overlying the side surface 404. The coating 405 can have an average thickness (tc), which may be measured by a slicing the abrasive article, viewing the abrasive article using a suitable technique (e.g., optical microscope or SEM) and taking a statistically relevant number of random sample measurements to determine an average thickness of the coating (tc). For a coating having a non-uniform thickness, the average thickness can be measured at random radial and/or circumferential positions from a suitable sample size to determine an average thickness.

According to one embodiment, the coating 405 can have an average thickness (tc) of at least 10 microns, such as at least 15 microns or at least 20 microns or at least 30 microns or at least 50 microns or at least 60 microns or at least 70 microns or at least 100 microns or at least 200 microns or at least 300 microns or at least 400 microns or at least 500 microns or at least 600 microns or at least 700 microns or even at least 800 microns. Still, in another non-limiting embodiment, the coating 405 can have an average thickness (tc) of not greater than 1 mm, such as not greater than 900 microns or not greater than 800 microns or not greater than 700 microns or not greater than 600 microns or not greater than 500 microns or not greater than 400 microns or not greater than 300 microns or not greater than 200 microns or not greater than 150 microns or not greater than 100 microns or not greater than 90 microns or not greater than 70 microns or not greater than 50 microns or not greater than 30 microns. It will appreciated that the average thickness of the coating (tc) can be within a range between any of the minimum and maximum values noted above. For instance, the average thickness of the coating (tc) can be within a range between 10 microns and 1 mm, such as within a range between 15 microns to 600 microns. In a particular embodiment, the average thickness of the coating (tc) can be within a range between 30 microns to 400 microns, and in a more particular embodiment, the average thickness of the coating (tc) can be within a range between 60 microns to 150 microns.

In at least one embodiment, the coating 405 can have a particular average thickness (tc) relative to the thickness (t) of the body 401 of the bonded abrasive. For example, the abrasive article 400 may have a thickness ratio (tc/t) of not greater than 1, such as not greater than greater 0.9 or not greater than 0.8 or not greater than 0.7 or not greater than 0.6 or not greater than 0.5 or not greater than 0.4 or not greater than 0.3 or not greater than 0.2 or not greater than 0.1 or not greater than 0.08 or not greater than 0.05 or not greater than 0.04 or not greater than 0.03. Still, in another non-limiting embodiment, the thickness ratio (tc/t) may be at least 0.005, such as at least 0.006 or at least 0.008 or at least 0.01, at least 0.05 or at least 0.1 or at least 0.2 or at least 0.25 or at least 0.3 or at least 0.4 or at least 0.5 or at least 0.6 or at least 0.7 or at least 0.8 or at least 0.9. It will be appreciated that the thickness ratio (tc/t) can be within a range including any of the minimum and maximum values noted above. For example, the thickness ratio (tc/t) can be within a range between 0.005 to 0.9, such as within a range between 0.008 to 0.2. In a particular embodiment, the thickness ratio (tc/t) can be within a range between 0.005 to 0.1, and in a more particularly embodiment, the thickness ratio (tc/t) can be within a range between 0.008 to 0.05. In another particular embodiment, the thickness of the coating can be 0.1% to 3% of the thickness of the wheel without the coating.

According to one embodiment, the coating 405 can include a cermet. More particularly, the coating 405 may consist essentially of a cermet, such that in at least one embodiment, the coating can be made entirely of a cermet 405. A cermet includes a composite material including at least one phase comprising a metal or metal alloy and one phase comprising one or more ceramic compounds. The one or more ceramic compounds can include an oxide, a carbide, a nitride, a boride, or any combination thereof. In at least one embodiment, the metal phase can be the majority phase, such that the metal defines an interconnected network extending throughout a majority of the body. In another embodiment, the ceramic phase can be the majority phase, such that the ceramic particles define an interconnected network extending throughout a majority of the body.

In one aspect, the coating 405 can include at least one element from the group of chromium, nickel, carbon, nitrogen, tungsten, sulfur, molybdenum, iron, zinc, silicon, titanium, aluminum, zirconium, magnesium, zinc, boron, cobalt, calcium, or any combination thereof. In one particular embodiment, the coating 405 can include a metal alloy within the metal phase of the cermet. The metal alloy may include a transition metal element. For example, in one particular embodiment, the metal phase can include chromium, and more particularly may include nickel and chromium. In at least one embodiment, the metal phase can consist essentially of a nickel chromium alloy.

For a coating including a cermet, the ceramic phase of the cermet may include a carbide. In at least one embodiment, the ceramic phase can include a transition metal carbide compound. For example, the ceramic phase may include chromium carbide. In at least one embodiment, the cermet includes a multiphase material including a first phase (e.g., a ceramic phase) comprising chromium carbide and a second phase (e.g., metal phase) comprising a nickel chromium alloy. The nickel chromium alloy may include a greater content of nickel as compared to chromium, including for example, a mixture including approximately 80% nickel and 20% chromium.

According to one particular aspect, the cermet may include a particular content of the ceramic phase (Cc) and a particular content of the metal phase (Cm). For example, the content of the ceramic phase (Cc) may be at least 5 vol % based on the entire volume of the cermet, which may be the entire volume of the coating 405. In another embodiment, the content of the ceramic phase (Cc) maybe greater, such as at least 10 vol % or at least 20 vol % or at least 30 vol % or at least 40 vol % or at least 50 vol % or at least 60 vol % or at least 70 vol % or even at least 80 vol % or at least 90 vol %. Still, in at least one non-limiting embodiment, the content of ceramic phase (Cc) in the cermet can be not greater than 99 vol %, such as not greater than 90 vol % or not greater than 80 vol % or not greater than 70 vol % or not greater than 60 vol % or not greater than 50 vol % or not greater than 40 vol % or not greater than 30 vol % or not greater than 20 vol % or not greater than 10 vol % or not greater than 5 vol %. It will be appreciated that the content of the ceramic phase (Cc) in the cermet can be within a range between any of the minimum and maximum percentages noted above.

In another embodiment, the content of the metal phase (Cm) may be at least 5 vol % based on the entire volume of the cermet, which may be the entire volume of the coating 405. In another embodiment, the content of the metal phase (Cm) maybe greater, such as at least 10 vol % or at least 20 vol % or at least 30 vol % or at least 40 vol % or at least 50 vol % or at least 60 vol % or at least 70 vol % or even at least 80 vol % or at least 90 vol %. Still, in at least one non-limiting embodiment, the content of metal phase (Cm) in the cermet can be not greater than 99 vol %, such as not greater than 90 vol % or not greater than 80 vol % or not greater than 70 vol % or not greater than 60 vol % or not greater than 50 vol % or not greater than 40 vol % or not greater than 30 vol % or not greater than 20 vol % or not greater than 10 vol % or not greater than 5 vol %. It will be appreciated that the content of the metal phase (Cm) in the cermet can be within a range between any of the minimum and maximum percentages noted above.

According to at least one aspect, the cermet may have a particular ratio between the content (vol %) of the ceramic phase (Cc) relative to the content of the metal phase (Cm). For example, the cermet may have a content ratio (Cc/Cm) that may be not greater than 10, such as not greater than 8 or not greater than 6 or not greater than 5 or not greater than 4 or not greater than 3 or not greater than 2 or not greater than 1.8 or not greater than 1.5 or not greater than 1.2 or not greater than 1 or not greater than 0.9 or not greater than 0.8 or not greater than 0.7 or not greater than 0.6 or not greater than 0.5 or not greater than 0.4 or not greater than 0.3 or not greater than 0.2 or not greater than 0.1 or not greater than 0.05 Still, in another non-limiting embodiment, the content ratio (Cc/Cm) may be at least 0.01, such as at least 0.05 or at least 0.1 or at least 0.2 or at least 0.3 or at least 0.4 or at least 0.5 or at least 0.6 or at least 0.7 or at least 0.8 or at least 0.9 or at least 0.95 or at least 1 or at least 1.5 or at least 2 or at least 3 or at least 4 or even at least 5. It will be appreciated that the content ratio (Cc/Cm) may be within a range between any of the minimum and maximum values noted above, including for example, within a range including at least 1 and not greater than 10, such as within a range including at least 2 and not greater than 8 or even within a range including at least 3 and not greater than 6.

In certain instances, the coating 405 may have a particular surface roughness (Ra), which may facilitate improved performance of the abrasive article. The surface roughness of the exterior surface of the coating may facilitate improved cooling and/or lubricity of the side surface during operation of the abrasive article. The surface roughness may be a result of the processing method or post-processing roughening operations. According to at least one embodiment, the exterior surface of the coating 405 may have a surface roughness (Ra) of at least 20 microns as measured using optical microscopy. In other embodiments, the surface roughness (Ra) of the exterior surface of the coating 405 may be at least 40 microns such as at least 60 microns or at least 80 microns or at least 90 microns or at least 100 microns or at least 120 microns or at least 150 microns or at least 175 microns or at least 200 microns or at least 300 microns or at least 400 microns or at least 500 microns or at least 600 microns or at least 800 microns. Still, in at least one non-limiting embodiment, the surface roughness can be not greater than 1 mm, such as not greater than 900 microns or not greater than 800 microns or not greater than 700 microns or not greater than 600 microns or not greater than 500 microns or not greater than 400 microns or not greater than 300 microns or not greater than 200 microns. It will be appreciated that the surface roughness may be within a range including any of the minimum and maximum values noted above.

Figure 5:
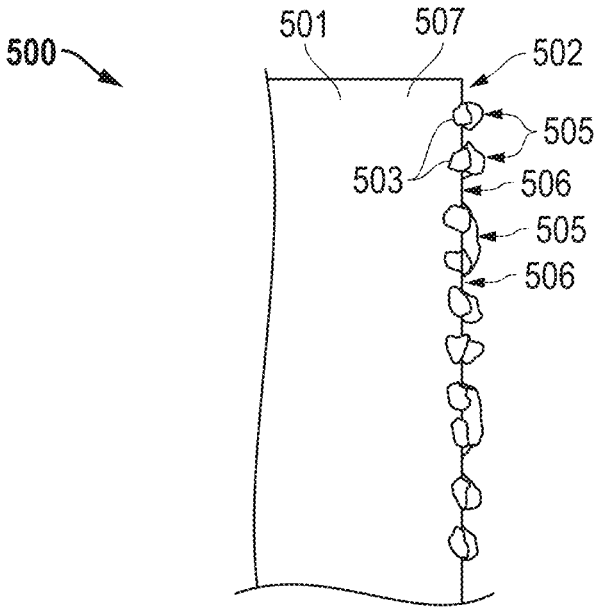

FIG. 5 includes a cross-sectional view of a portion of an abrasive article including a bonded abrasive body and a coating according to an embodiment. As illustrated, the abrasive article 500 includes a bonded abrasive having a body 501, which includes abrasive particles 503 contained within a bond material 507. In at least one embodiment, the abrasive article 500 includes a coating 505. As illustrated, the coating 505 may be a discontinuous layer defining gap regions 506 between coating regions 505. In at least one embodiment, the coating 505 is a selective coating, such that it overlies select portions of the body 501 and is not present in other regions, thereby defining the gap regions where the exterior surface of the body 501, such as portions of the first major surface 502 are exposed. According to one particular embodiment, the coating 505 can be selectively placed to overlie the abrasive particles 503. As illustrated in FIG. 5, the coating 505 is overlying and bonded directly to the abrasive particles 503 that are exposed at the first major surface 502 of the body 501. However, for those portions of the first major surface 502 where there are no abrasive particles exposed and only defined by the bond material 507, such portions are substantially uncoated and define the gap regions 506. As further illustrated, the portions of the first major surface 502 defined by the bond material 507 are uncoated and define the gap regions 506.

Accordingly, in one embodiment, a greater content of the coating 505 is overlying the abrasive particles 503 as compared to the content of the coating 505 overlying the bond material 507.

Such selectivity of the coating may be achieved by the process used to apply the coating. For example, in at least one embodiment, the selective coating may be achieved by depositing the coating in a manner such that it preferentially is bonded to the abrasive particles, but is not necessarily readily bonded to the bond material of the body. This may be achieved through suitable selection of the abrasive particles, bond material, and coating material. In one particular embodiment, a selective coating may be achieved by using a thermal spraying process to apply the coating. More particularly, the process may include a high velocity oxide fuel deposition process to form the coating.

Referring again to aspects of the coating, the coating may have a particular wear resistance. For example, the coating may have a wear resistance of at least 0.01 $mm^3$/6000 cycles according to the ASTM G65 test. In other embodiments, the wear resistance may be greater, such as at least 0.1 $mm^3$/6000 cycles or at least 0.2 $mm^3$/6000 cycles or at least 0.4 $mm^3$/6000 cycles or at least 0.6 $mm^3$/6000 cycles or at least 0.8 $mm^3$/6000 cycles or at least 1 $mm^3$/6000 cycles or at least 2 $mm^3$/6000 cycles or at least 4 $mm^3$/6000 cycles or at least 6 $mm^3$/6000 cycles or at least 8 $mm^3$/6000 cycles or at least 10 $mm^3$/6000 cycles or at least 20 $mm^3$/6000 cycles or at least 40 $mm^3$/6000 cycles or at least 60 $mm^3$/6000 cycles or at least 80 $mm^3$/6000 cycles. Still, in one non-limiting embodiment, the wear resistance can be not greater than 100 $mm^3$/6000 cycles or not greater than 80 $mm^3$/6000 cycles or not greater than 60 $mm^3$/6000 cycles or not greater than 40 $mm^3$/6000 cycles or not greater than 20 $mm^3$/6000 cycles or not greater than 10 $mm^3$/6000 cycles or not greater than 8 $mm^3$/6000 cycles or not greater than 6 $mm^3$/6000 cycles or not greater than 4 $mm^3$/6000 cycles or not greater than 2 $mm^3$/6000 cycles or not greater than 1 $mm^3$/6000 cycles or not greater than 0.8 $mm^3$/6000 cycles or not greater than 0.6 $mm^3$/6000 cycles or not greater than 0.4 $mm^3$/6000 cycles or not greater than 0.2 $mm^3$/6000 cycles or not greater than 0.1 $mm^3$/6000 cycles. It will be appreciated that the wear resistance can be within a range including any of the minimum and maximum values noted above.

In another embodiment, the coating can have a particular static coefficient of friction. For example, the coating can have a static coefficient of friction less than 0.8 ($\mu_s$) according to ASTM C1028. For example, the coating may have a static coefficient of friction of less than 0.7 $\mu_s$, such as less than 0.6 $\mu_s$ or less than 0.5 $\mu_s$ or less than 0.4 $\mu_s$ or less than 0.3 $\mu_s$. Still, in at least one non-limiting embodiment, the static coefficient of friction can be at least 0.2 $\mu_s$, such as at least 0.3 $\mu_s$ or at least 0.4 $\mu_s$ or at least 0.5 $\mu_s$ or at least 0.6 $\mu_s$ or at least 0.7 $\mu_s$. It will be appreciated that the static coefficient of friction can be within a range including any of the minimum and maximum values noted above.

In another embodiment, the coating can have a particular thermal conductivity. For example, the coating can have a thermal conductivity of at least 1 W/m·K. In other embodiments, the thermal conductivity of the coating may be greater, such as at least 2 W/m·K or at least 5 W/m·K or at least 10 W/m·K or at least 25 W/m·K or at least 50 W/m·K or at least 75 W/m·K or at least 100 W/m·K or at least 150 W/m·K or at least 200 W/m·K or at least 250 W/m·K or at least 300 W/m·K or at least 350 W/m·K or at least 400 W/m·K or at least 450 W/m·K. Still, in one non-limiting embodiment, the thermal conductivity can be not greater than 500 W/m·K or not greater than 450 W/m·K or not greater than 400 W/m·K or not greater than 350 W/m·K or not greater than 300 W/m·K or not greater than 250 W/m·K or not greater than 200 W/m·K or not greater than 150 W/m·K or not greater than 100 W/m·K or not greater than 75 W/m·K or not greater than 50 W/m·K or not greater than 25 W/m·K or not greater than 10 W/m·K or not greater than 5 W/m·K. It will be appreciated that the thermal conductivity can be within a range including any of the minimum and maximum values noted above.

In another embodiment, the coating can have a particular hardness. For example, the coating can have a hardness of at least 500 (Vickers hardness scale). In other embodiments, the hardness of the coating may be greater, such as at least 600 or at least 800 at least 1000 or at least 1200 or at least 1500 or at least 1800 or at least 2000 or at least 2200 or at least 2500 or at least 2800 or at least 3000 or at least 3200 or at least 3500. Still, in one non-limiting embodiment, the hardness can be not greater than 3500 or not greater than 3200 or not greater than 3000 or not greater than 2800 or not greater than 2500 or not greater than 2200 or not greater than 2000 or not greater than 1800 or not greater than 1500 or not greater than 1200 or not greater than 1000 or not greater than 800 or not greater than 600. It will be appreciated that the hardness can be within a range including any of the minimum and maximum values noted above.

In another embodiment, the coating can have a particular emissivity. For example, the coating can have an emissivity of less than 0.9 according to ASTM E1933-99a. For example, the coating may have an emissivity of less than 0.8 or less than 0.7 or less than 0.6 or less than 0.5 or less than 0.4 or less than 0.3 or less than 0.2. Still, in at least one non-limiting embodiment, the emissivity can be at least 0.1, such as at least 0.2 or at least 0.3 or at least 0.4 or at least 0.5 or at least 0.6 or at least 0.7 or at least 0.8. It will be appreciated that the emissivity can be within a range including any of the minimum and maximum values noted above.

Figure 6:
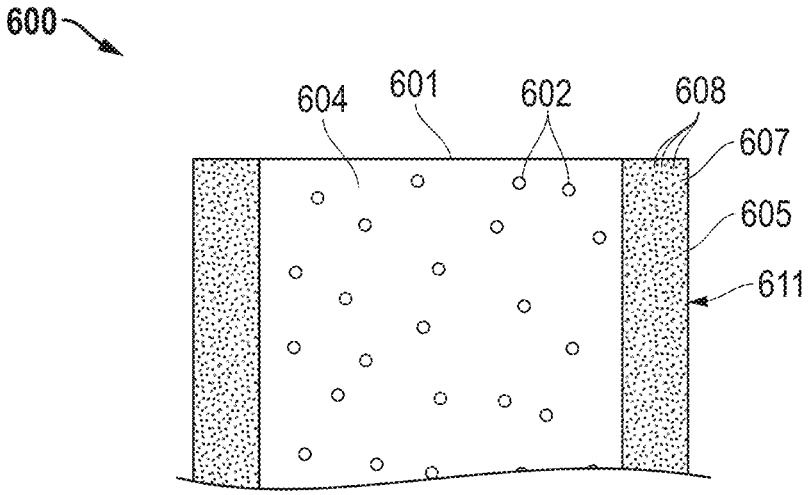
FIG. 6 includes a cross-sectional image of a portion of an abrasive article according to an embodiment.

FIG. 6 includes a cross-sectional illustration of a portion of an abrasive article including a bonded abrasive body and a coating according to an embodiment. As illustrated, the coating 605 can include a binder material 607 and particles 608 contained within the binder material 607. The coating 605 can be formed according to any of the processes disclosed herein. For example, the coating 605 can be formed using a deposition process, such as a dip coating process, a spray coating process, or the like.

In an embodiment, the coating 605 can include a certain content of the particles 608 that can facilitate performance of the abrasive articles. For example, the coating 605 can include the particles 608 in a content of at least 42 wt. % for a total weight of the coating, such as at least 45 wt. % or at least 52 wt. % or at least 58 wt. % or at least 60 wt. % or at least 64 wt. % or at least 68 wt. % or at least 71 wt. % or at least 75 wt. % or at least 81 wt. % or at least 88 wt. % or at least 90 wt. %. In another instance, the coating 605 can include the particles 608 in a content of at most 91 wt. % for a total weight of the coating, such as at most 88 wt. % or at most 85 wt. % or at most 80 wt. % or at most 78 wt. % or at most 76 wt. % or at most 72 wt. % or at most 68 wt. % or at most 63 wt. % or at most 60 wt. %. Moreover, the content of the particles 608 can be in a range including any of the minimum and maximum percentages noted herein. For instance, the coating 605 can include the particles 608 in a content in a range including at least 42 wt. % and at most 91 wt. %, such as in a range including at least 60 wt. % and at most 90 wt. %. In a particular embodiment, the particles 608 can include chromium carbide (e.g., $Cr_3C_2$). In a more particular embodiment, the coating 605 can include particles containing chromium carbide in a content in a range including any of the minimum and maximum percentages noted herein. In another particular embodiment, the particles 608 are chromium carbide particles. In another more particular embodiment, chromium carbide particles can be present in the coating in a content in a range including any of the minimum and maximum percentages noted herein.

In another embodiment, the coating 605 can include a certain content of the binder material 607 that can facilitate formation of the coating. For example, the coating 605 can include the binder material 607 in a content of at least 9 wt. % for a total weight of the coating, such as at least 10 wt. % or at least 15 wt. % or at least 18 wt. % or at least 20 wt. % or at least 24 wt. % or at least 29 wt. % or at least 32 wt. % or at least 36 wt. % or at least 40 wt. %. In another instance, the coating 605 can include the binder material 607 in a content of at most 42 wt. % for a total weight of the coating, such as at most 40 wt. % or at most 37 wt. % or at most 35 wt. % or at most 32 wt. % or at most 28 wt. % or at most 23 wt. % or at most 20 wt. % or at most 18 wt. % or at most 15 wt. % or at most 12 wt. % or at most 10 wt. %. Moreover, the content of the binder material 607 can be in a range including any of the minimum and maximum percentages noted herein. For instance, the coating 605 can include the binder material 607 in a content in a range including at least 9 wt. % and at most 42 wt. %, such as in a range including at least 10 wt. % and at most 40 wt. % or in a range including at least 15 wt. % and at most 32 wt. %.

In a further embodiment, the coating 605 can include a certain ratio (wp/wb) of the weight content of the particles 608 (wp) to the weight content of the binder material 607 (wb) that can facilitate formation and performance of the coating 608. For example, the ratio (wp/wb) can be at least 1.2, such as at least 1.5 or at least 1.8 or at least 2.1 or at least 2.3 or at least 2.5 or at least 2.8 or at least 3.2 or at least 3.4 or at least 3.6 or at least 3.8 or at least 4.1 or at least 4.2 or at least 4.6 or at least 5.1 or at least 5.3 or at least 5.5 or at least 6.2 or at least 6.6 or at least 7.4 or at least 7.9 or at least 8.1 or at least 8.5 or at least 8.8 or at least 9. In another instance, the ratio (wp/wb) can be at most 9.1, such as at most 8.5 or at most 7.6 or at most 7.2 or at most 6.8 or at most 6.4 or at most 6.2 or at most 5.8 or at most 5.4 or at most 5.2 or at most 4.8 or at most 4.5 or at most 4.3 or at most 3.8 or at most 3.6 or at most 3.2 or at most 2.8 or at most 2.6 or at most 2.2 or at most 1.6. Moreover, the ratio (wp/wb) can be in a range including any of the minimum and maximum values noted herein. For instance, the ratio (wp/wb) can be in a range including at least 1.2 and at most 9.1, such as in a range including at least 2.8 and at most 6.2.

The binder material 607 can include an organic material, inorganic material, or a combination thereof. In at least one embodiment, the binder material 607 may include at least one material selected from the group of organic materials, polymers, resins, metals, ceramics, vitreous materials, or any combination thereof. According to one aspect, the binder material 607 can include one or more natural organic materials, synthetic organic materials, or a combination thereof. In particular instances, the binder material 607 may include a thermoset, a thermoplastic, or a combination thereof. For example, some suitable materials for use as the binder material 607 can include a phenolic, epoxy, polyester, cyanate ester, shellac, polyurethane, rubber, and a combination thereof. In one particular embodiment, the binder material 607 can include phenolic resin, and more particularly, may consist essentially of phenolic resin. According to one aspect, the binder material 607 can be essentially the same or exactly the same material as the bond material 604 of the body 601 of the bonded abrasive. The binder material 607 and the bond material 604 may be bonded to each other. In certain instances, the binder material 607 may be applied to the surface of the body 601 and cured, such that the binder material 607 and bond material 604 are adhered and bonded directly to each other.

The binder material 607 may form a continuous three-dimensional phase throughout the entire volume of the coating 605. As such, as illustrated in FIG. 6, the particles 608 can be contained within the binder material 607 and dispersed through the volume of the binder material 607, such that the particles 608 define a discontinuous and discrete phase in the volume of the coating 605. As illustrated in FIG. 6, the particles can be substantially uniformly distributed throughout the volume of the binder material 607 and throughout the volume of the coating 605. Still, it will be appreciated that in other embodiments, the coating 605 may utilized a non-uniform distribution of the particles 608 within the binder material 607.

Figure 7:
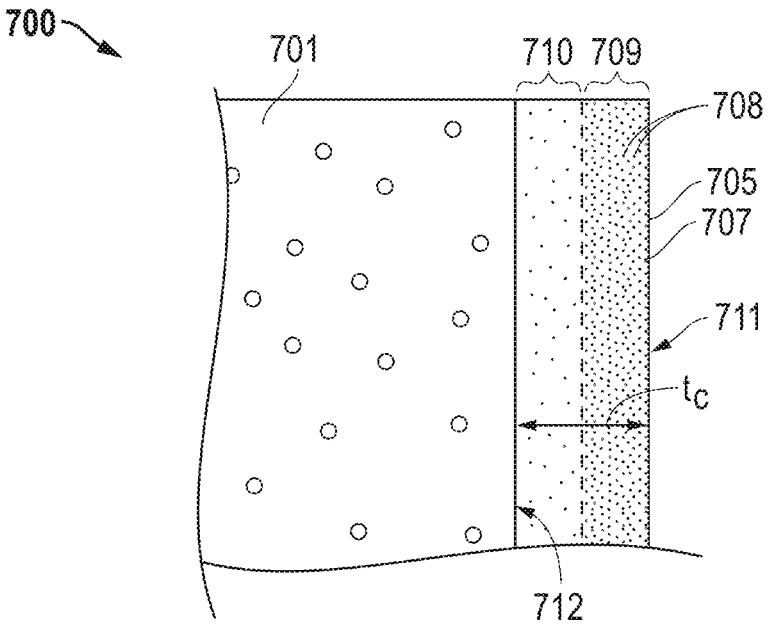
FIG. 7 includes a cross-sectional image of a portion of an abrasive article according to an embodiment.
Figure 8:
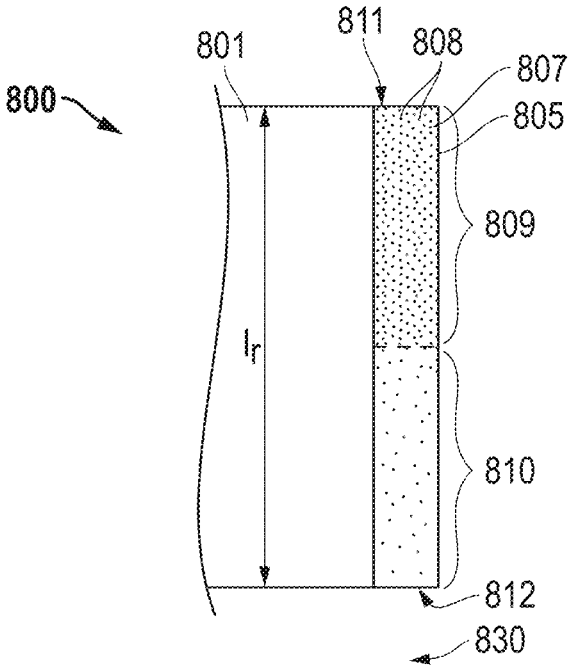
FIG. 8 includes a cross-sectional image of a portion of an abrasive article according to an embodiment.

Referring briefly to FIGS. 7-8, exemplary coatings using non-uniform distributions of the particles within the binder material are illustrated. FIG. 7 includes a cross-sectional illustration of a portion of an abrasive article 700 including a bonded abrasive having a body 701 and a coating 705 overlying at least a portion of a major surface of the body 701. The coating 705 can include a binder material 707 and particles 708 contained within the binder material 707. As illustrated, the content of the particles 708 in the binder material 707 varies along the thickness (tc) of the coating 705, such that the content of particles 708 contained in the binder material 707 in the region 709 is greater than the content of the particles 708 contained within the binder material 707 in the region 710. As such, the particles 708 are non-uniformly dispersed within the binder material 707, wherein a greater content of particles 708 are contacting the exterior surface of the binder material 707 and the exterior surface 711 of the coating 705 compared to a content of particles 708 at the interface 712 between the coating 705 and the body 701. Such an arrangement is considered an axial non-uniform distribution of the particles 708 in the binder 707 because the content of the particles 707 in the binder material 707 varies with the axial position in the coating 705, where the axial axis is parallel to the direction defining the thickness of the coating 705. It will be appreciated that such a difference in the concentration can be a gradient defining a gradual change in the concentration. In another embodiment, the difference in concentration may also be a more discrete change defining two or more intervals or an interface defining a discrete change in the concentration of the particles 708. It will also be appreciated that other non-uniform distributions of the particles 808 within the binder material 707 may be used, including for example, an embodiment wherein the content of the particles 708 within the binder material 707 in the region 710 is greater than the content of the particles 708 contained within the binder material 707 in the region 709.

In another embodiment, a non-uniform distribution of the particles 708 within the binder material 707 may be formed by creating the coating from a plurality of films overlying each other. In such instances, at least two of the films in the plurality of films may include a different content of particles 708, such that the coating can be formed by creating successive films, wherein the content of abrasive particles 708 in each of the films can be selected and altered from any of the other films as suitable.

FIG. 8 includes a cross-sectional illustration of a portion of an abrasive article 900 including a bonded abrasive having a body 801 and a coating 805 overlying at least a portion of a major surface of the body 801. The coating 805 can include a binder material 807 and particles 808 contained within the binder material 807. As illustrated, the content of the particles 808 in the binder material 807 varies along the radial length (lr) of the body 801, such that the content of particles 808 contained in the binder material 807 in the region 809 is different than the content of the particles 808 contained within the binder material 807 in the region 810. More particularly, in one embodiment, the content of the particles 808 contained within the binder material 807 within the region 809 can be greater than the content of the particles 808 contained within the binder material 807 within the region 809. As such, the particles 808 are non-uniformly dispersed within the binder material 807, wherein a greater content of particles 908 are contacting a peripheral exterior surface 811 of the coating 805 compared to a content of particles 808 at the inner surface 812 of the coating 805 defining a portion of the central opening 830. Such an arrangement is considered a radial non-uniform distribution of the particles 808 in the binder 807 because the content of the particles 807 in the binder material 807 varies with the radial position in the coating 805. It will be appreciated that such a difference in the concentration can be a gradient defining a gradual change in the concentration of the particles 808 within the binder material 807. In another embodiment, the difference in concentration may also be a more discrete change defining two or more intervals including an interface defining a discrete change in the concentration of the particles 808. It will also be appreciated that other non-uniform distributions of the particles 808 within the binder material 807 may be used, including for example, an embodiment wherein the content of the particles 808 within the binder material 807 in the region 810 is greater than the content of the particles 908 contained within the binder material 807 in the region 809.

Referring again to FIG. 6, the particles 608 can include an inorganic material. For example, the particles 608 can include a cermet, ceramic, or any combination thereof. In another embodiment, the particles 608 can be either cermet or ceramic depending on their compositions. In at least one embodiment the particles 608 can consist essentially of a cermet. A cermet can include any of the cermet compositions described herein. For example, the particles 608 can include a cermet including composite material including at least one phase comprising a metal or metal alloy and one phase comprising one or more ceramic compounds. The one or more ceramic compounds can include an oxide, a carbide, a nitride, a boride, or any combination thereof. In at least one embodiment, the metal phase can be the majority phase, such that the metal defines an interconnected network extending throughout a majority of the body. In another embodiment, the ceramic phase can be the majority phase, such that the ceramic phase defines an interconnected network extending throughout a majority of the body, which may be a polycrystalline phase of material. In one aspect, the particles 608 including the cermet can include at least one element from the group of chromium, nickel, carbon, nitrogen, tungsten, sulfur, molybdenum, iron, zinc, silicon, titanium, aluminum, zirconium, magnesium, zinc, boron, cobalt, calcium, or any combination thereof. In one particular embodiment, the particles 608 including the cermet can include a metal alloy within the metal phase. The metal alloy may include a transition metal element. For example, in one particular embodiment, the metal phase can include chromium, and more particularly, may include nickel and chromium. In at least one embodiment, the metal phase can consist essentially of a nickel chromium alloy. In at least one embodiment, the cermet of the particles 608 can include a multiphase material including a first phase (e.g., a ceramic phase) comprising chromium carbide and a second phase (e.g., metal phase) comprising a nickel chromium alloy. In a further embodiment, the particles 608 can include a ceramic. In a particular embodiment, the particles 608 can consist essentially of a ceramic. In another embodiment, the particles 608 can include a chromium-containing material. In a particular embodiment, the particles 608 can include chromium carbide. In a more particular embodiment, the particles 608 can consist essentially of chromium carbide.

In another embodiment, the particles 608 may have a Mohs hardness of not greater than 9, such as less than 8 or less than 7 or less than 6 or even less than 5. Still, the particles 608 may have a Mohs hardness of at least 1, such as at least 2 or at least 3 or at least 4 or at least 5 or at least 6. It will be appreciated that the particles can have a Mohs hardness within a range including any of the minimum and maximum values noted above.

In still another embodiment, the particles 608 can have a Vickers hardness of at least 500. In other embodiments, the Vickers hardness of the particles 608 may be greater, such as at least 600 or at least 800 at least 1000 or at least 1200 or at least 1500 or at least 1800 or at least 2000 or at least 2200 or at least 2500 or at least 2800 or at least 3000 or at least 3200 or at least 3500. Still, in one non-limiting embodiment, the Vickers hardness of the particles 608 can be not greater than 3500 or not greater than 3200 or not greater than 3000 or not greater than 2800 or not greater than 2500 or not greater than 2200 or not greater than 2000 or not greater than 1800 or not greater than 1500 or not greater than 1200 or not greater than 1000 or not greater than 800 or not greater than 600. It will be appreciated that the Vickers hardness of the particles 608 can be within a range including any of the minimum and maximum values noted above.

The particles 608 can have a particular size, which may facilitate the performance of the coating 605. For example, the particles 608 can have an average particle size not greater than 1 mm, such as not greater than 900 microns or not greater than 800 microns or not greater than 700 microns or not greater than 600 microns or not greater than 500 microns or not greater than 400 microns or not greater than 300 microns or not greater than 200 microns or not greater than 100 microns or not greater than 90 microns or not greater than 80 microns or not greater than 70 microns or not greater than 60 microns or not greater than 50 microns or not greater than 40 microns or even not greater than 30 microns or not greater than 25 microns or not greater than 23 microns or not greater than 20 microns or not greater than 15 microns or not greater than 10 microns or not greater than 8 microns or not greater than 5 microns. According to one non-limiting embodiment, the average particle size of the particles 608 can be at least about 0.1 microns, such as at least 0.5 microns or at least 1 micron or at least 2 microns or at least 3 microns or at least 5 microns or at least 8 microns or at least about 10 microns or at least 20 microns or at least 30 microns or at least 40 microns or at least 50 microns. It will be appreciated that the average particle size of the particles can be within a range including any of the minimum and maximum values noted above, including for example, but not limited to, within a range including at least 0.1 microns and not greater than 500 microns, or even within a range including at least 1 micron and not greater than 50 microns. In a particular embodiment, the average particle size of the particles can be within a range including at least 2 microns to not greater than 40 microns.

The particles 608 may have a certain average particle size relative to the abrasive particles 602, which may facilitate the performance of the abrasive article. For example, the particles 608 can have an average particle size (PSp) and the abrasive particles 602 can have an average particle size (PSab), wherein PSp is different compared to PSab. In at least one embodiment, PSp can be less than PSab. In one particular example, the abrasive article may have a particle size ratio (PSp/PSab) having a value of not greater than 1, such as greater than 0.95 or not greater than 0.9 or not greater than 0.8 or not greater than 0.7 or not greater than 0.6 or not greater than 0.5 or not greater than 0.4 or not greater than 0.3 or not greater than 0.2 or not greater than 0.1 or not greater than 0.5. Still, in at least one embodiment, the particle size ratio (PSp/PSab) can be at least 0.01, such as at least 0.05 or at least 0.1 or at least 0.15 or at least 0.2 or at least 0.25 or at least 0.3 or at least 0.35 or at least 0.4 or at least 0.5 or at least 0.6 or at least 0.7 or at least 0.8 or at least 0.9. It will be appreciated that the particle size ratio (PSp/PSab) can be within a range including any of the minimum and maximum values noted above, including for example, but not limited to, within a range including at least 0.01 and not greater than 0.5 or within a range including at least 0.01 and not greater than 0.3.

The particles 608 may have a certain average particle size relative to the average thickness (tc) of the coating 605, which may facilitate the performance of the abrasive article. For example, the particles 608 can have an average particle size (PSp) and the coating can have an average thickness (tc), wherein the average particle size (PSp) is different than the average thickness (tc) of the coating 605. In at least one embodiment, PSp can be less than the average thickness (tc) of the coating 605. In one particular example, the abrasive article may have a particle size-to-thickness ratio (PSp/tc) having a value of not greater than 1, such as greater than 0.95 or not greater than 0.9 or not greater than 0.8 or not greater than 0.7 or not greater than 0.6 or not greater than 0.5 or not greater than 0.4 or not greater than 0.3 or not greater than 0.2 or not greater than 0.1 or not greater than 0.5. Still, in at least one embodiment, the particle size-to-thickness ratio (PSp/tc) can be at least 0.01, such as at least 0.05 or at least 0.1 or at least 0.15 or at least 0.2 or at least 0.25 or at least 0.3 or at least 0.35 or at least 0.4 or at least 0.5 or at least 0.6 or at least 0.7 or at least 0.8 or at least 0.9. It will be appreciated that the particle size-to-thickness ratio (PSp/tc) can be within a range including any of the minimum and maximum values noted above, including for example, but not limited to, within a range including at least 0.01 and not greater than 0.5 or within a range including at least 0.01 and not greater than 0.2.

The coating 605 may be formed to have a particular content of the particles 608, which may facilitate the performance of the abrasive article. For example, the coating 605 may include at least 20 vol % particles 608 for the total volume of the coating 605. In other instances, the content of the particles 608 in the coating 605 can be greater, such as at least 30 vol % or at least 40 vol % or at least 50 vol % or at least 60 vol % or at least 70 vol %. Still, in one non-limiting embodiment, the total content of the particles 608 within the coating 605 can be not greater than 80 vol % or not greater than 75 vol % or not greater than 70 vol % or not greater than 60 vol % or not greater than 50 vol % or not greater than 40 vol %. It will be appreciated that the total content of the particles 608 in the coating can be within a range including any of the minimum and maximum values noted above, including for example, but not limited to, at least 20 vol % and not greater than 80 vol % or at least 30 vol % and not greater than 70 vol %. In those embodiments having a non-uniform distribution of the particles, the total content is average for the total volume of the coating.

In certain instances, the coating 605 may be a conformal coating and overlie all components of the body 601, including the abrasive particles 602 and the bond material 604. As such, in at least one non-limiting embodiment, the coating 605 can be a non-selective coating. Moreover, as noted herein, the binder material 607 of the coating 605 can be bonded directly to the bond material 604.

According to one embodiment, the exterior surface 611 of the coating 605 can be relatively smooth. For example, the exterior surface 611 of the coating 605 can have an average surface roughness (Ra) of not greater than 1 mm, such as within a range including any of the values noted above associated with the surface roughness.

Many different aspects and embodiments are possible. Some of those aspects and embodiments are described herein. After reading this specification, skilled artisans will appreciate that those aspects and embodiments are only illustrative and do not limit the scope of the present invention. Embodiments may be in accordance with any one or more of the embodiments as listed below.

EMBODIMENTS

Embodiment 1

An abrasive article comprising:
a body including:
abrasive particles contained within a bond material;
a first major surface, a second major surface, and a side surface extending between the first major surface and second major surface; and
a coating overlying at least a portion of one of the first major surface or the second major surface, wherein the coating comprises a cermet.

Embodiment 2

An abrasive article comprising:
a body including:
abrasive particles contained within a bond material;
a first major surface, a second major surface, and a side surface extending between the first major surface and second major surface; and
a coating overlying at least a portion of one of the first major surface or the second major surface, wherein the portion of the first major surface or second major surface including the coating comprises a surface roughness of at least 20 microns.

Embodiment 3

An abrasive article comprising:
a body including:
abrasive particles contained within a bond material;
a first major surface, a second major surface, and a side surface extending between the first major surface and second major surface; and
a coating overlying at least a portion of one of the first major surface or the second major surface, wherein a greater content of the coating overlies the abrasive particles compared to a content of coating overlying the bond material.

Embodiment 4

An abrasive article comprising:
a body including:
abrasive particles contained within a bond material;
a first major surface, a second major surface, and a side surface extending between the first major surface and second major surface; and
a coating overlying at least a portion of one of the first major surface or the second major surface, wherein the coating comprises at least one property selected from the group consisting of:
a wear resistance of at least 0.15 mm3/6000 cycles in ASTM G65 test;
a static coefficient of friction less than 0.8 ($\mu_s$);
a thermal conductivity of at least 10 W/m·K;
a hardness of at least 550 (Vickers hardness scale);
an emissivity less than 0.9; or
any combination thereof.

Embodiment 5

An abrasive article comprising:
a body including:
abrasive particles contained within a bond material;
a first major surface, a second major surface, and a side surface extending between the first major surface and second major surface; and
a coating overlying at least a portion of one of the first major surface or the second major surface, wherein the coating comprises at least one element selected from the group of chromium, nickel, carbon, nitrogen, tungsten, sulfur, molybdenum, iron, zinc, silicon, titanium, aluminum, zirconium, magnesium, zinc, boron, cobalt, calcium, or any combination thereof.

Embodiment 6

An abrasive article comprising:
a body including:
abrasive particles contained within a bond material;
a first major surface, a second major surface, and a side surface extending between the first major surface and second major surface; and a coating overlying at least a portion of one of the first major surface or the second major surface, wherein the coating comprises a binder material and particles contained within the binder material, wherein the particles comprise a cermet, ceramic, or any combination thereof.

Embodiment 7

The abrasive article of any one of embodiments 1, 2, 3, 4, 5, and 6, wherein the body comprises a thickness (t) and a diameter (D) defining an aspect ratio (D:t) of at least 10:1 or at least 20:1 or at least 30:1 or at least 40:1 or at least 50:1 or at least 60:1 or at least 70:1 or at least 80:1 or at least 90:1 or at least 100:1.

Embodiment 8

The abrasive article of any one of embodiments 1, 2, 3, 4, 5, and 6, wherein the coating overlies a majority of at least the first major surface or second major surface of the body.

Embodiment 9

The abrasive article of any one of embodiments 1, 2, 3, 4, 5, and 6, wherein the coating defines an annular region on at least one of the first major surface or second major surface of the body.

Embodiment 10

The abrasive article of any one of embodiments 1, 2, 3, 4, 5, and 6, wherein the coating overlies essentially all of the first major surface.

Embodiment 11

The abrasive article of any one of embodiments 1, 2, 3, 4, 5, and 6, wherein the coating overlies essentially all of the first major surface and second major surface.

Embodiment 12

The abrasive article of any one of embodiments 1, 2, 3, 4, 5, and 6, wherein the coating overlies only a portion of the side surface and defines exposed regions on the side surface that are essentially free of the coating.

Embodiment 13

The abrasive article of any one of embodiments 1, 2, 3, 4, 5, and 6, wherein the coating is bonded directly to at least portion of the first major surface or second major surface.

Embodiment 14

The abrasive article of any one of embodiments 1, 2, 3, 4, 5, and 6, wherein the coating comprises a thickness (tc), and wherein the thickness is substantially the same across a radial axis of the body.

Embodiment 15

The abrasive article of any one of embodiments 1, 2, 3, 4, 5, and 6, wherein the coating comprises a thickness (tc), and wherein the thickness is substantially different across a radial axis of the body.

Embodiment 16

The abrasive article of any one of embodiments 1, 2, 3, 4, 5, and 6, wherein the abrasive particles include at least one material selected from the group of oxides, carbides, nitrides, borides, diamond, natural minerals, or any combination thereof.

Embodiment 17

The abrasive article of any one of embodiments 1, 2, 3, 4, 5, and 6, wherein the bond material comprises at least one material selected from the group of organic materials, polymers, resins, metals, ceramics, vitreous materials, or any combination thereof.

Embodiment 18

The abrasive article of any one of embodiments 1, 2, 3, 4, 5, and 6, wherein the bond material comprises phenolic resin.

Embodiment 19

The abrasive article of any one of embodiments 1, 2, 3, 4, 5, and 6, wherein the body comprises a content of bond material within a range between at least 30 volume % and not greater than 65 volume %.

Embodiment 20

The abrasive article of any one of embodiments 1, 2, 3, 4, 5, and 6, wherein the body comprises a content of abrasive particles within a range between at least 30 volume % and not greater than 56 volume %.

Embodiment 21

The abrasive article of any one of embodiments 1, 2, 3, 4, 5, and 6, wherein the body further comprises at least one filler contained within the bond material, wherein the filler is at least one material selected from the group of fibers, particles, hollow particles, hollow spheres, ceramics, glasses, metals, oxides, carbides, nitrides, borides, halogen-containing compounds, alkali metal containing compounds, alkali earth metal-containing compounds, compounds including at least one transition metal element, minerals, sulfates, titanates, chlorides, polymers, resins, thermosets, thermoplastics, or any combination thereof.

Embodiment 22

The abrasive article of any one of embodiments 1, 2, 3, 4, 5, and 6, wherein the coating has a thickness (tc) of at least 10 microns.

Embodiment 23

The abrasive article of any one of embodiments 1, 2, 3, 4, 5, and 6, wherein the coating has a thickness (tc) of not greater than 1 millimeter.

Embodiment 24

The abrasive article of any one of embodiments 1, 2, 3, 4, 5, and 6, wherein the body further comprises a porosity within a range between at least 0 vol % and not greater than 30 vol %.

Embodiment 25

The abrasive article of any one of embodiments 2, 3, 4, and 5, wherein the coating comprises a cermet.

Embodiment 26

The abrasive article of any one of embodiments 1 and 25, wherein the cermet comprises at least one element selected from the group of chromium, nickel, carbon, tungsten, sulfur, molybdenum, iron, zinc, silicon, titanium, aluminum, zirconium, magnesium, zinc, boron, cobalt, calcium, carbides, nitrides, or any combination thereof.

Embodiment 27

The abrasive article of any one of embodiments 1 and 25, wherein the cermet comprises chromium carbide.

Embodiment 28

The abrasive article of any one of embodiments 1 and 25, wherein the cermet comprises nickel and chromium.

Embodiment 29

The abrasive article of any one of embodiments 1 and 25, wherein the cermet comprises a multiphase material including a first phase comprising chromium carbide and a second phase comprising nickel chromium.

Embodiment 30

The abrasive article of any one of embodiments 1, 3, 4, 5, and 6, wherein the portion of the surface including the coating comprises an average surface roughness of at least 20 microns or at least 100 microns or at least 200 microns or at least 500 microns or at least 800 microns or at least 900 microns.

Embodiment 31

The abrasive article of embodiment 30, wherein the average surface roughness is not greater than 1 mm, or not greater than 900 microns or not greater than 800 microns or not greater than 700 microns or not greater than 600 microns or not greater than 500 microns.

Embodiment 32

The abrasive article of any one of embodiments 1, 2, 4, 5, and 6, wherein a greater content of the coating overlies the abrasive particles compared to a content of coating overlying the bond material.

Embodiment 33

The abrasive article of any one of embodiments 1, 2, 3, 5, and 6, wherein the coating comprises at least one property selected from the group consisting of:

a wear resistance of at least 0.15 mm3/6000 cycles in ASTM G65 test a static coefficient of friction less than 0.8 ($\mu_s$);

a thermal conductivity of at least 10 W/m·K;

a hardness of at least 550 (Vickers hardness scale);

an emissivity less than 0.9; or any combination thereof.

Embodiment 34

The abrasive article of any one of embodiments 1, 2, 3, 4, 5, and 6, wherein the bond material defines a continuous phase extending throughout the volume of the body.

Embodiment 35

The abrasive article of any one of embodiments 1, 2, 3, 4, 5, and 6, wherein the body is essentially free of a substrate.

Embodiment 36

The abrasive article of embodiment 6, wherein the binder material of the coating is essentially the same as the bond material.

Embodiment 37

The abrasive article of embodiment 6, wherein the binder material comprises at least one material selected from the group of organic materials, polymers, resins, metals, ceramics, vitreous materials, or any combination thereof.

Embodiment 38

The abrasive article of embodiment 6, wherein the binder material comprises phenolic resin.

Embodiment 39

The abrasive article of embodiment 6, wherein the binder material defines a continuous phase and the particles are dispersed within the binder material.

Embodiment 40

The abrasive article of embodiment 6, wherein the particles are substantially uniformly dispersed within the binder material.

Embodiment 41

The abrasive article of embodiment 6, wherein the particles are non-uniformly dispersed within the binder material.

Embodiment 42

The abrasive article of embodiment 6, wherein the particles are non-uniformly dispersed within the binder material, wherein a greater content of particles contacting an exterior surface of the binder material compared to a content of particles at the interface between the coating and the body.

Embodiment 43

The abrasive article of embodiment 6, wherein the particles comprise a ceramic selected from the group consisting of oxides, carbides, nitrides, borides, or any combination thereof.

Embodiment 44

The abrasive article of embodiment 6, wherein the particles have a hardness that is different than the abrasive particles.

Embodiment 45

The abrasive article of embodiment 6, wherein the particles have a Mohs hardness of not greater than 9 or less than 5.

Embodiment 46

The abrasive article of embodiment 6, wherein the particles have an average particle size less than an average particle size of the abrasive particles.

Embodiment 47

The abrasive article of embodiment 6, wherein the particles have an average particle size within a range of at least 0.1 microns and not greater than 500 microns.

Embodiment 48

The abrasive article of embodiment 6, wherein the particles have an average particles size less than an average thickness (tc) of the coating.

Embodiment 49

The abrasive article of embodiment 6, wherein the coating comprises a content of particles within a range of at least 20 vol % and not greater than 75 vol %.

Embodiment 50

The abrasive article of embodiment 6, wherein the particles comprise at least one element selected from the group of chromium, nickel, carbon, tungsten, sulfur, molybdenum, iron, zinc, or any combination thereof.

Embodiment 51

The abrasive article of embodiment 6, wherein the cermet comprises chromium carbide.

Embodiment 52

The abrasive article of embodiment 6, wherein the cermet comprises nickel and chromium.

Embodiment 53

The abrasive article of embodiment 6, wherein the cermet comprises a multiphase material including a first phase comprising chromium carbide and a second phase comprising nickel chromium.

Embodiment 54

The abrasive article of embodiment 6, wherein the coating is non-selective, substantially overlying the abrasive particles and bond material.

Embodiment 55

The abrasive article of embodiment 6, wherein the binder material is bonded directly to the bond material of the body.

Embodiment 56

A method of making an abrasive article comprising: applying a coating to at least one of a first major surface of a second major surface of a body, wherein the body includes abrasive particles contained within a bond material, and wherein the coating comprises at least one feature selected from the group consisting of:

a) wherein the coating comprises a cermet;
b) wherein the portion of the first major surface or second major surface including the coating comprises a surface roughness of at least 400 microns;
c) wherein a greater content of the coating overlies the abrasive particles compared to a content of coating overlying the bond material;
d) wherein the coating comprises a thermal conductivity of at least 10 W/m·K; or
e) any combination of any of the features a-e; and further wherein the process of applying a coating is selected from the group consisting of:

i) thermal spraying;
ii) spray coating;
iii) printing;
iv) depositing;
v) curing;
vi) sintering; or
vii) any combination of any of the processes i-vi.

Embodiment 57

An abrasive article comprising:

a body including:

abrasive particles contained within a bond material;

a first major surface, a second major surface, and a side surface extending between the first major surface and second major surface; and a coating overlying at least a portion of one of the first major surface or the second major surface, wherein the coating comprises a binder material and particles within the binder material, the particles comprising at least one element selected from the group of chromium, nickel, carbon, nitrogen, tungsten, sulfur, molybdenum, iron, zinc, silicon, titanium, aluminum, zirconium, magnesium, zinc, boron, cobalt, calcium, or any combination thereof.

Embodiment 58

The abrasive article of Embodiment 57, wherein the particles comprises a cermet.

Embodiment 59

The abrasive article of Embodiment 57, wherein the particles comprise a ceramic.

Embodiment 60

The abrasive article of Embodiment 57, wherein the particles comprises chromium carbide.

Embodiment 61

The abrasive article of Embodiment 57, wherein the particles are present in a content of at least 42 wt. % for a total weight of the coating.

Embodiment 62

The abrasive article of Embodiment 57, wherein the particles are present in a content of at least 60 wt. % and at most 90 wt. % for a total weight of the coating.

Embodiment 63

The abrasive article of Embodiment 57, wherein the particles have a hardness that is different than the abrasive particles.

Embodiment 64

The abrasive article of Embodiment 57, wherein the particles have an average particle size less than an average particle size of the abrasive particles.

Embodiment 65

The abrasive article of Embodiment 57, wherein the particles have an average particle size within a range of at least 0.1 microns and not greater than 500 microns.

Embodiment 66

The abrasive article of Embodiment 57, wherein the particles have an average particle size within a range of at least 2 microns to not greater than 50 microns.

Embodiment 67

The abrasive article of Embodiment 57, wherein the particles have an average particles size less than an average thickness (tc) of the coating.

Embodiment 68

The abrasive article of Embodiment 57, wherein the coating comprises an average thickness of at least 15 microns and not greater than 600 microns.

Embodiment 69

The abrasive article of Embodiment 57, wherein the binder material of the coating is essentially the same as the bond material.

Embodiment 70

The abrasive article of Embodiment 57, wherein the binder material defines a continuous phase and the particles are dispersed within the binder material.

EXAMPLES

Example 1

Four bonded abrasive wheels were created to have different coatings. All of the samples used the same type of grinding wheel, which is a grinding wheel available as Foundry from Norton Corporation. The wheel had 71 wt % abrasive particles, 14 wt % of resin, and 15 wt % of fillers. The grinding wheel had a diameter of 20 inches, an average thickness before coating of approximately 0.225 inches, and a total thickness after coating between 0.230-0.240 inches.

A first sample (Sample 1) was coated with a cermet of $Cr_3C_2$—NiCr where the nickel chromium alloy phase was approximately 20-25 wt % of the material. The cermet was applied using a thermal spraying process of high velocity oxide fuel (HVOF). The process used a Liquid-Fuel HVOF process with a K2 Gun from GTV GmbH. In this process, the energy and speed was achieved via combustion of oxygen with kerosene, occurring in a de-laval type nozzle at high flows, which generated a high speed flame plume. The powder was fed into the nozzle and achieved a molten or semi-molten state in-flight. The parameters used for HVOF of the cermet included a nozzle reference of 200/11, an oxygen flow rate of 900 l/min, a kerosene flow rate of 261/h, a spraying distance or 400 mm, a powder feed rate or 100 gr/min, a linear relative speed or 1 m/s, and 34 passes over the outer major surfaces of the first abrasive wheel sample.

Figure 9:
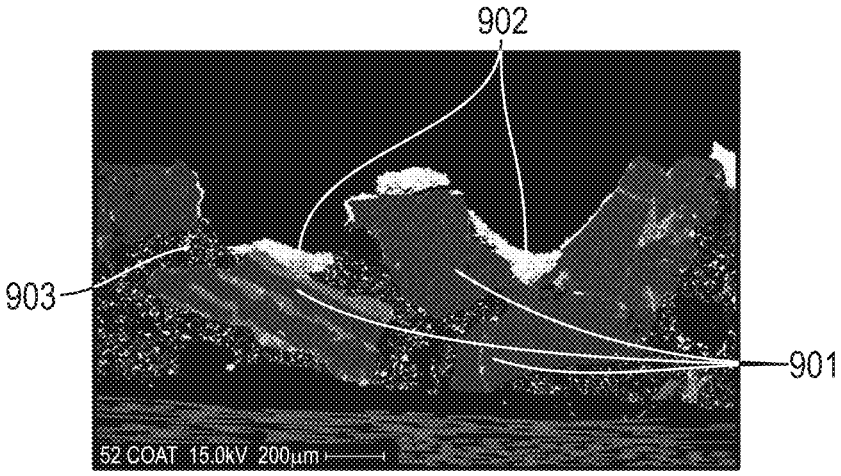
FIG. 9 includes a SEM image of a portion of an abrasive article according to an embodiment.

FIG. 9 includes a SEM image of a portion of the abrasive article of Sample 1. Notably, the coating was a selective coating that was primarily overlying the abrasive particles and defined gap regions where the bond material was exposed at the exterior surface. As illustrated, the coating 902 is selectively overlying the abrasive particles 901, and the bond regions 903 do not necessarily have the same level of coating 902 as the abrasive particles 901.

Figure 10:
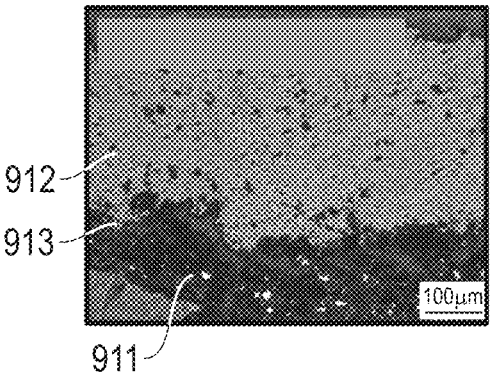
FIGS. 10-12 include SEM images of abrasive articles including a coating.

A second coated abrasive wheel sample (Sample 2) used the same grinding wheel as Sample 1 (i.e., Foundry X), but was coated with a ceramic material of $Cr_2O_3$—$Al_2O_3$, wherein the $Cr_2O_3$ was 75 wt % of the material. The ceramic material was applied via plasma spraying using a ProPlasma plasma gun from Saint-Gobain Coating Solutions and using the parameters of Table 1 provided below. FIG. 10 includes a SEM image of a portion of the abrasive article of Sample 2. Notably, the coating 912 is generally conformal and non-selective, such that it overlies the abrasive particles 911 and the bond material 913.

TABLE 1

| Plasma Spray parameters (SGCS ProPlasma Gun) | $Cr_2O_3$—$Al_2O_3$ (15-45 μm) | $Al_2O_3$—$TiO_2$ (10-30 μm) | $ZrO_2$—MgO (15-45 μm) |
|---|---|---|---|
| Argon flow (slpm) | 40 | 45 | 45 |
| Hydrogen flow (slpm) | 13 | 10 | 10 |
| Arc Intensity (Amps) | 630 | 550 | 600 |
| Voltage (V) | 66 | 65 | 65 |
| Spray distance (mm) | 110 | 110 | 110 |
| Powder feed rate (gr/min) | 45 | 30 | 45 |
| Linear relative speed (mm/s) | 800 | 800 | 800 |

Figure 11:
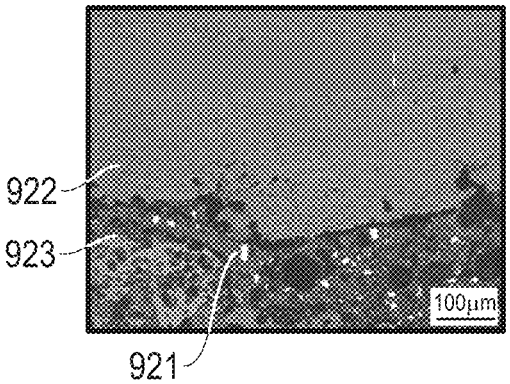

A third abrasive wheel sample (Sample 3), using the same underlying grinding wheel as Sample 1, was coated with a ceramic material of $Al_2O_3$—$TiO_2$, wherein the $Al_2O_3$ was 40 wt % of the material. The ceramic material was applied via plasma spraying according to the process of Table 1 above. FIG. 11 includes a SEM image of a portion of the abrasive article of Sample 3. Notably, the coating 922 is generally conformal and non-selective, such that it overlies the abrasive particles 921 and the bond material 923.

Figure 12:
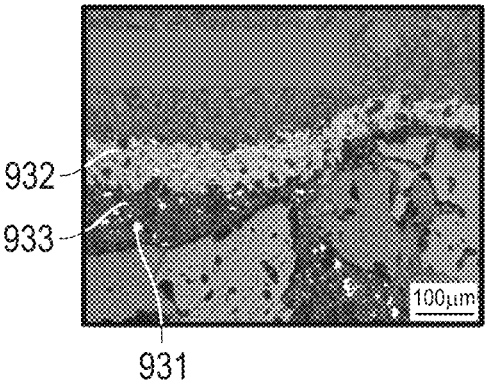

A fourth abrasive wheel sample (Sample 4) was created by forming a coating of a ceramic material on the same type of grinding wheel as used in Sample 1. The ceramic material was $ZrO_2$—MgO, wherein the $ZrO_2$ was 77 wt % of the material. The ceramic material was applied via plasma spraying according to the process of Table 1 above. FIG. 12 includes a SEM image of a portion of the abrasive article of Sample 4. Notably, the coating 932 is generally conformal and non-selective, such that it overlies the abrasive particles 931 and the bond material 933.

Each of the wheels were then performance tested on a Braun cut-off machine, at a cutting speed of 16500 sfpm, on a workpiece of 1018 carbon steel in the shape of a bar having a diameter of 3 inches, at a feed rate of 0.2 inches/second.

Figure 13:
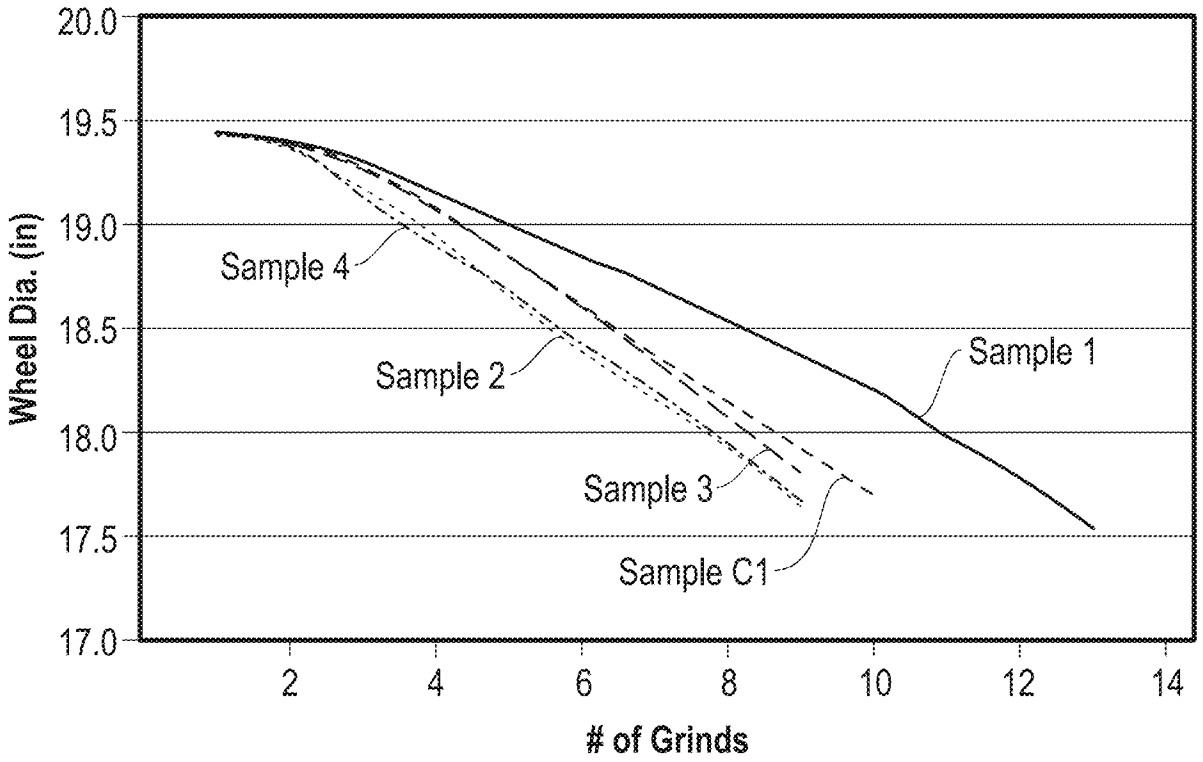
FIG. 13 includes a plot of wheel diameter versus number of grinds for a representative sample and other abrasive articles.

FIG. 13 includes a plot of wheel diameter versus number of grinds for the wheels of Samples 1-4 tested according the grinding conditions noted above. The plot further includes a conventional sample (Sample C1) without a coating, commercially available as FoundryX from Norton Corporation. As illustrated, the abrasive wheel of Sample 1 demonstrated superior performance relative to all other samples. Notably, the calculated G-ratio (i.e., material removed from the workpiece relative to the material lost from the abrasive wheels) for Sample 1 was approximately 40% greater than the conventional wheel with no coating and Samples 2-4.

The temperature change of the grinding wheel during the grinding operation was measured on the circular face of the grinding wheel with an Infrared Camera (FLIR SC6701 SLS with a 25 mm lens). The temperature of a spinning wheel is measured continuously at a location that is half a revolution after the wheel cuts the workpiece. A small fin sits at the location of temperature measurement to deflect sparks from entering the field of view of the camera and influencing the temperature measurements. The temperature was recorded from the start of the first cut to the last cut of the wheel. In order to get correct temperature measurements, we measured the emissivity of a standard specification wheel before and after it was used. The emissivity in the wavelength of the camera (7.5-13 microns) is between 0.93 and 0.936. The wheel speed is 16500 SFPM and the IR camera integration time is 0.0706 ms, which acts like a spatial temperature average of 5 mm in the direction of the rotating wheel.

Table 2 below summarizes the peak temperature during the grinding test compared to the conventional sample (Sample C1), representing the conventional sample C1 without a coating. As demonstrated by the data, the peak temperature during grinding using Sample 1 was notably less than the conventional sample and less than Samples 2-4. Accordingly, Sample 1 provided improved G-ratio and lower peak temperature during the grinding test compared to all other samples tested.

TABLE 2

| Sample | Peak Temperature (° C.) | G-Ratio |
|---|---|---|
| Sample C1 | Reference | 1.84 |
| Sample 1 | −100 | 2.53 (+30%) |
| Sample 3 | −25 | 1.69 (−10%) |
| Sample 2 | −100 | 1.56 (−15%) |
| Sample 4 | −100 | 1.56 (−15%) |

Example 2

A new grinding wheel sample having a coating was created according to an embodiment. The sample used a grinding wheel available as Foundry from Norton Corporation. The wheel had 71 wt % abrasive particles, 14 wt % of resin, and 15 wt % of fillers. The grinding wheel had a diameter of 20 inches, an average thickness before coating of approximately 0.225 inches, and a total thickness after coating between 0.230-0.240 inches.

A liquid mixture was created by mixing ceramic particles of $Cr_3C_2$ with a phenolic resin. The ceramic particles had an average particle size of approximately 20 microns, and were commercially available as AMPERIT® 580.054 from H. C. Starck Corporation. The mixture included 70 wt % of the cermet particles for the total weight of the mixture. The mixture was then deposited on the major faces of the bonded abrasive wheel using a brush to form a coated bonded abrasive body identified as Sample S1-2.

The abrasive wheel of Sample S1-2 was then tested according to the grinding conditions note above in Example 1.

Figure 14:
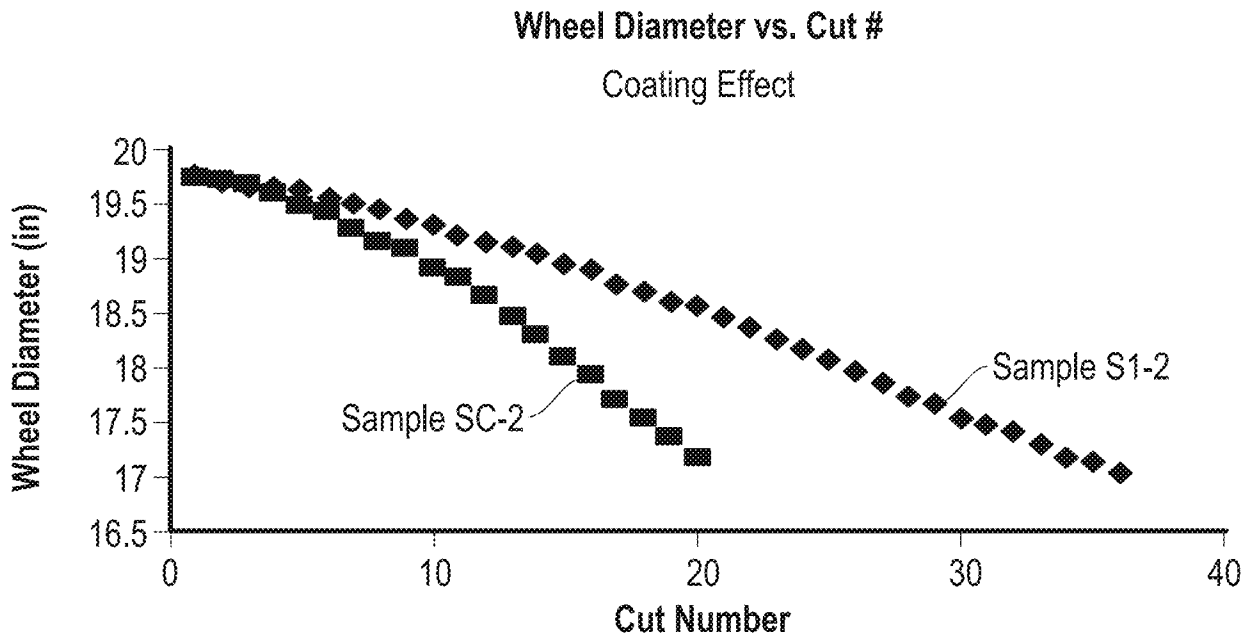
FIG. 14 includes a plot of wheel diameter versus number of grinds for a representative sample and a conventional, uncoated abrasive article.

FIG. 14 includes a plot of wheel diameter versus cut number for the representative sample (Sample S1-2) and a conventional, uncoated abrasive wheel (Sample SC-2), which is commercially available as FoundryX from Norton Corporation. The wheel wear profile of Sample S1-2 is significantly different and more linear than the wheel wear profile of Sample SC-2. Sample S1-2 is able to remove the same amount of material as Sample SC-2 with significantly less wear which results in a wheel with approximately 100% improvement in product life without increase in the wheel power draw.

Figure 15:
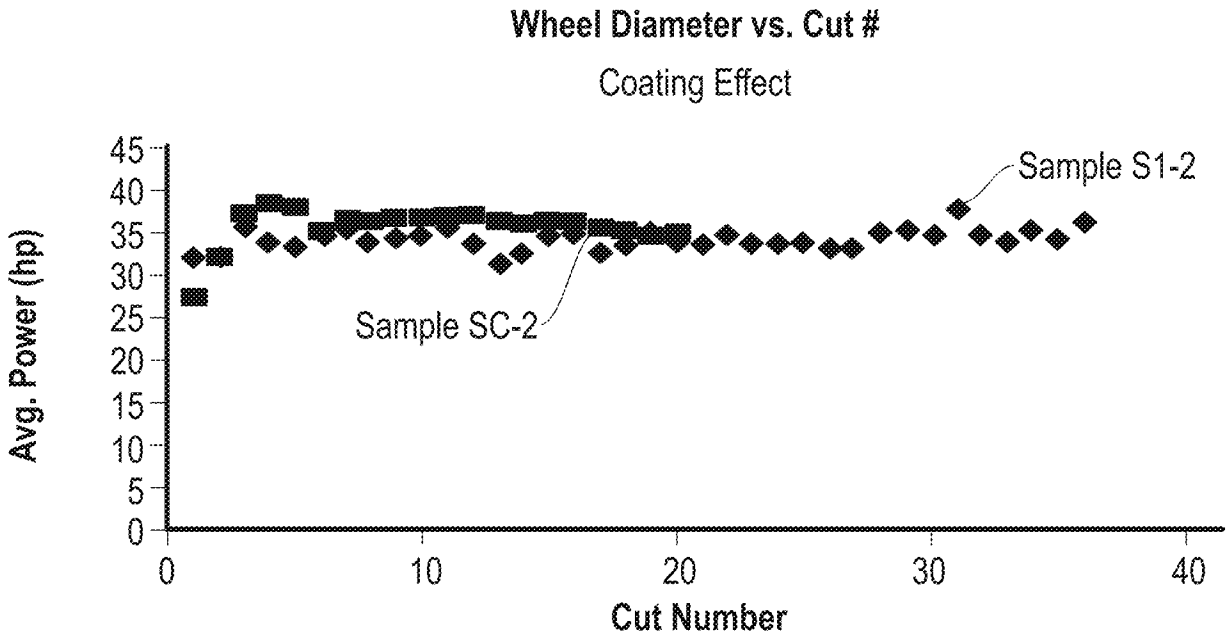
FIG. 15 includes a plot of average power versus cut number for a representative sample and a conventional sample.

FIG. 15 includes a plot of average power versus cut number for the representative sample (Sample S1-2) and the conventional sample (Sample SC-2). As illustrated in both FIGS. 14 and 15, Sample S1-2 outperformed the conventional sample, demonstrating approximately 100% improvement in the G-ratio based upon a cut number that was double the cut number achieved by the conventional sample (Sample SC-2).

Example 3

Representative grinding wheel samples, Sample S3-1 and Sample S3-2, were formed using the same type of grinding wheels and in the same manner as disclosed in Example 2 except that $Cr_3C_2$ particles having different average particle sizes were used to form Samples S3-1 and S3-2. The average $Cr_3C_2$ particle size for Sample S3-1 was about 23 microns, and for Sample S3-2 about 5 microns. The coatings of Sample S3-1 and Sample S3-2 were otherwise the same. The average coating thickness was about 144 microns. An uncoated grinding wheel was used as a control sample, Sample SC-3.

Each of the wheel samples were then performance tested on a Braun cut-off machine, at a cutting speed of 16500 sfpm, on a workpiece of 1018 carbon steel in the shape of a bar having a diameter of 3 inches, at a feed rate of 0.3 inches/second. The test was stopped when the wheels reached the final diameter of approximately 17 inches.

Figure 16:
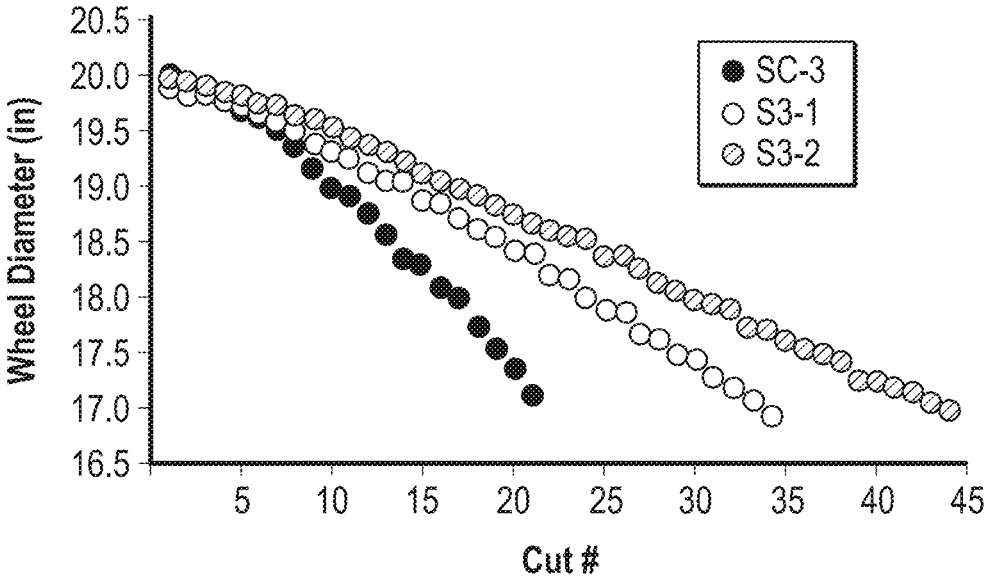
FIG. 16 includes a plot of wheel diameter versus number of grinds for representative samples and a conventional sample.
Figure 17:
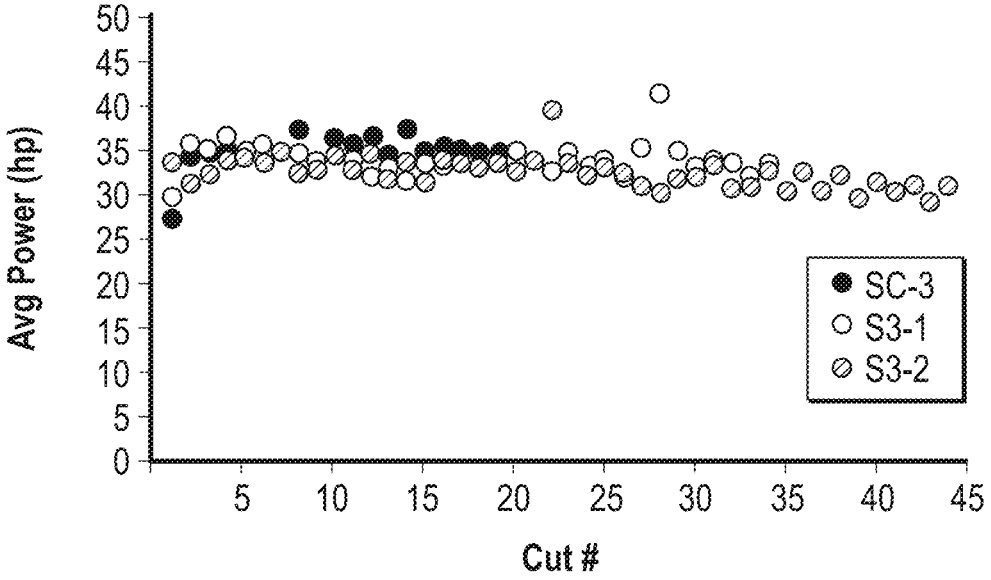
FIG. 17 includes a plot of average power versus cut number for representative samples and a conventional sample.

FIG. 16 includes a plot of wheel diameter versus cut number for Sample S3-1, Sample S3-2, and Sample SC-3. Sample S3-1 and Sample S3-2 were able to complete the same number of cuts as Sample SC-3 with significantly less wear. With increased numbers of cuts (e.g. >20), wear of Sample S3-2 was further improved compared to Sample S3-1. FIG. 17 includes a plot of average power versus cut number for Sample S3-1, Sample S3-2, and Sample SC-3. As disclosed in FIG. 17, the wheel power draw was similar among Sample S3-1, Sample S3-2, and Sample SC-3.

Example 4

Further representative grinding wheel samples were formed using the same type of grinding wheels and in the same manner as disclosed in Example 2 except for different contents of $Cr_3C_2$ particles and phenolic resin were used for forming different wheel samples. The weight contents of $Cr_3C_2$ particles and phenolic resin for the total weight of the liquid mixtures are included in Table 3 below. An un-coated grinding wheel was used as a control sample, Sample SC-4.

TABLE 3

| Composition | Sample S4-1 | Sample S4-2 | Sample S4-3 |
|---|---|---|---|
| Liquid phenolic resin (wt. %) | 28 | 52 | 76 |
| $Cr_3C_2$ ceramic particles (wt. %) | 72 | 48 | 24 |

The liquid mixture was cured to form the final coating on each sample. Due to volatilization and other changes in the final composition, the contents of the particles and binder material in the finally formed coating were different from the contents contained in the liquid mixture. Table 4 discloses changes of the contents between the liquid mixture and the final coating.

TABLE 4

| Component | Liquid mixture (wt. % for a total weight of the liquid mixture) | Finally formed coating (wt. % for a total weight of the coating) |
|---|---|---|
| Binder material | 20 to 80 | 10 to 40 |
| Particles | 20 to 80 | 60 to 90 |

Figure 18:
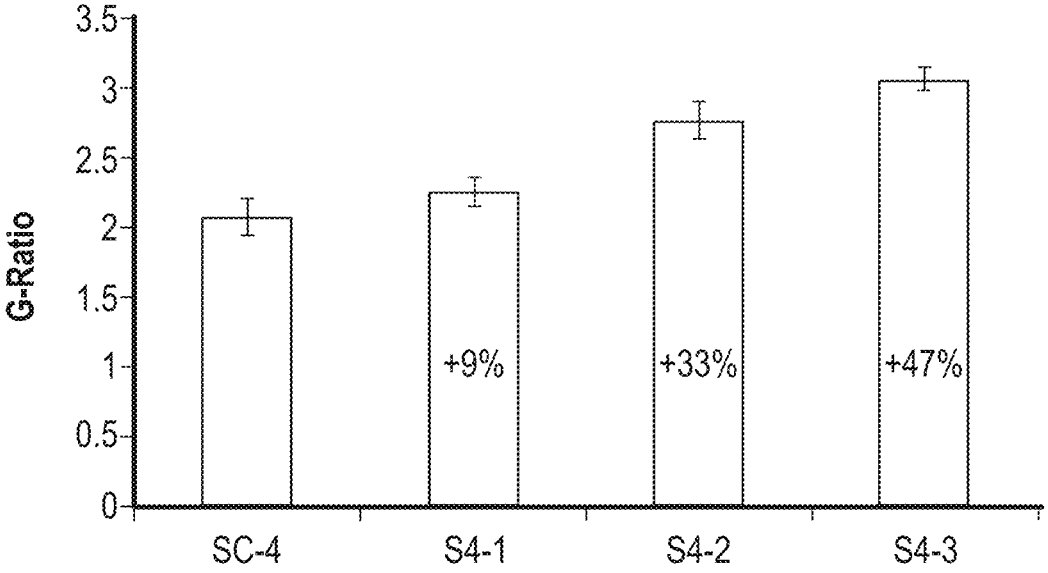
FIG. 18 includes a graph of G-Ratios of representative samples and a conventional sample.

Each of the wheel samples were then performance tested in the same manner as disclosed in Example 3. FIG. 18 includes a graph illustrating G-Ratio of all the samples. Compared to Sample SC-4, Samples S4-1, S4-2, and S4-3 demonstrated increased G-Ratio, and the increase was 9%, 33%, and 47% for Samples S4-1, S4-2, and S4-3, respectively, as compared to the G-Ratio of SC-4.

Example 5

Additional grinding wheel samples were made using the same type of grinding wheels and formed in the same manner as disclosed in Example 2, except that different volumes of the liquid mixture were applied to different wheels forming Samples S5-1, S5-2, S5-3, and S5-4, and the coating thickness of each wheel is included in Table 5 below. An un-coated grinding wheel was used as a control sample, Sample SC-5.

TABLE 5

| Representative samples | Thickness of the coating (microns) |
|---|---|
| S5-1 | 70 |
| S5-2 | 144 |
| S5-3 | 288 |
| S5-4 | 450 |

Each of the wheel samples were then performance tested in the same manner as disclosed in Example 3.

Figure 19:
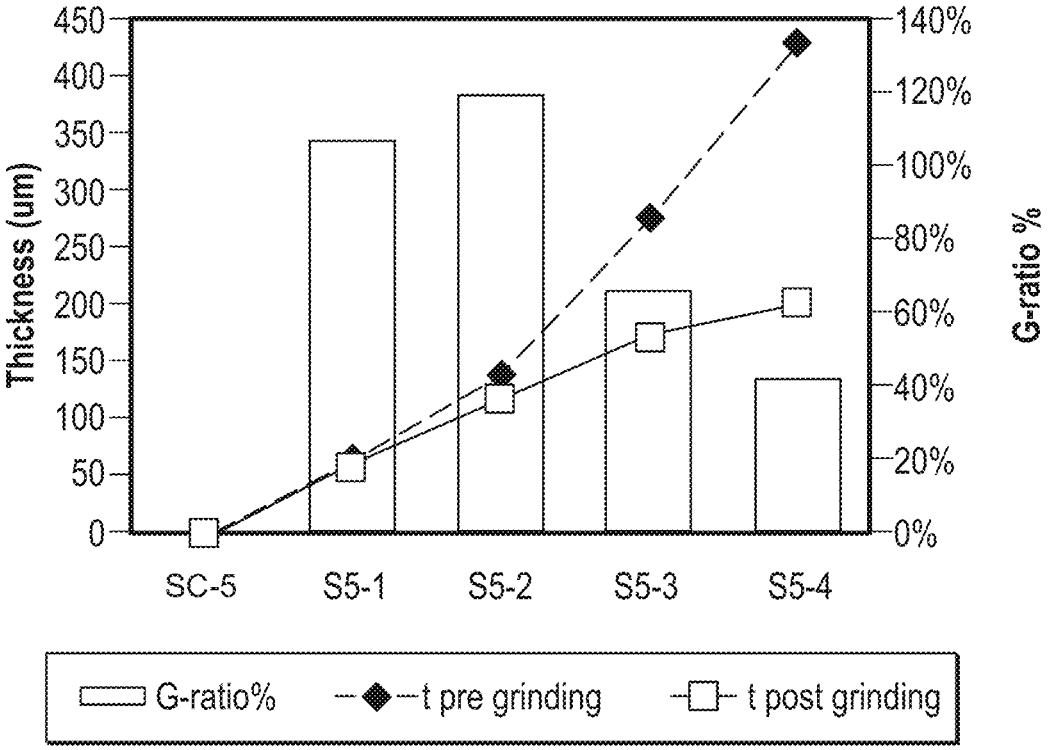
FIG. 19 includes a graph illustrating G-Ratio increases of representative samples compared to a conventional sample and thickness of coatings of representative samples before and after a grinding test.

FIG. 19 includes a graph illustrating changes of the thickness before and after the performance tests and G-Ratio % of each sample. G-Ratio % is determined by the formula of G-Ratio %=100% X $(G_s-G_{sc-5})/G_{sc-5}$, wherein $G_s$ is the G-Ratio of any tested sample and $G_{sc-5}$ is the G-Ratio of SC-5. Each representative sample demonstrated an increase in G-Ratio compared to Sample SC-5. For example, Samples S5-1 and S5-2 had an increase of 109% and 115%, respectively. Further, the coating thickness of Sample S5-1 did not appear to change between before and after the grinding test. Sample S5-2 demonstrated a slight decrease in the coating thickness after grinding, 144 microns vs. 130 microns. The original coating thickness of Sample S5-3 was 288 microns and reduced to 175 microns after grinding, and it was 450 microns for Sample S5-4 and reduced to 200 microns after grinding.

The specification and illustrations of the embodiments described herein are intended to provide a general understanding of the structure of the various embodiments. The specification and illustrations are not intended to serve as an exhaustive and comprehensive description of all of the elements and features of apparatus and systems that use the structures or methods described herein. Separate embodiments may also be provided in combination in a single embodiment, and conversely, various features that are, for brevity, described in the context of a single embodiment, may also be provided separately or in any subcombination. Further, reference to values stated in ranges includes each and every value within that range. Many other embodiments may be apparent to skilled artisans only after reading this specification. Other embodiments may be used and derived from the disclosure, such that a structural substitution, logical substitution, or another change may be made without departing from the scope of the disclosure. Accordingly, the disclosure is to be regarded as illustrative rather than restrictive. Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

The description in combination with the figures is provided to assist in understanding the teachings disclosed herein. The following discussion will focus on specific implementations and embodiments of the teachings. This focus is provided to assist in describing the teachings and should not be interpreted as a limitation on the scope or applicability of the teachings. However, other teachings can certainly be used in this application.

As used herein, the terms "comprises," "comprising," "includes," "including," "has," "having" or any other variation thereof, are intended to cover a non-exclusive inclusion. For example, a method, article, or apparatus that comprises a list of features is not necessarily limited only to those features but may include other features not expressly listed or inherent to such method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

Also, the use of "a" or "an" is employed to describe elements and components described herein. This is done merely for convenience and to give a general sense of the scope of the invention. This description should be read to include one or at least one and the singular also includes the plural, or vice versa, unless it is clear that it is meant otherwise. For example, when a single item is described herein, more than one item may be used in place of a single item. Similarly, where more than one item is described herein, a single item may be substituted for that more than one item.

Unless otherwise defined, all technical and scientific terms used herein have the same meaning as commonly understood by one of ordinary skill in the art to which this invention belongs. The materials, methods, and examples are illustrative only and not intended to be limiting. To the extent not described herein, many details regarding specific materials and processing acts are conventional and may be found in reference books and other sources within the structural arts and corresponding manufacturing arts.

The above-disclosed subject matter is to be considered illustrative, and not restrictive, and the appended claims are intended to cover all such modifications, enhancements, and other embodiments, which fall within the true scope of the present invention. Thus, to the maximum extent allowed by law, the scope of the present invention is to be determined by the broadest permissible interpretation of the following claims and their equivalents, and shall not be restricted or limited by the foregoing detailed description.

The Abstract of the Disclosure is provided to comply with Patent Law and is submitted with the understanding that it will not be used to interpret or limit the scope or meaning of the claims. In addition, in the foregoing Detailed Description of the Drawings, various features may be grouped together or described in a single embodiment for the purpose of streamlining the disclosure. This disclosure is not to be interpreted as reflecting an intention that the claimed embodiments require more features than are expressly recited in each claim. Rather, as the following claims reflect, inventive subject matter may be directed to less than all features of any of the disclosed embodiments. Thus, the following claims are incorporated into the Detailed Description of the Drawings, with each claim standing on its own as defining separately claimed subject matter.

What is claimed is:

1. An abrasive article comprising:

a body including:

abrasive particles contained within a bond material; and a first major surface, a second major surface opposite the first surface, and a side surface extending between the first major surface and second major surface; and a coating overlying at least a portion of the first major surface and at least a portion of the second major surface of the body, wherein the coating comprises a binder material and particles within the binder material, the particles comprising a cermet comprising at least one element selected from the group consisting of chromium, nickel, carbon, nitrogen, tungsten, sulfur, molybdenum, iron, silicon, titanium, aluminum, zirconium, magnesium, zinc, boron, cobalt, calcium, or any combination thereof.

2. The abrasive article of claim 1, wherein the cermet comprises the at least one element of chromium, nickel, or a combination thereof.

3. The abrasive article of claim 1, wherein the cermet including chromium carbide.

4. The abrasive article of claim 1, wherein the particles are present in a content of at least 42 wt. % for a total weight of the coating.

5. The abrasive article of claim 1, wherein the particles are present in a content of at least 60 wt. % and at most 90 wt. % for a total weight of the coating.

6. The abrasive article of claim 1, wherein the particles have a hardness that is different than the abrasive particles.

7. The abrasive article of claim 1, wherein the particles have an average particle size less than an average particle size of the abrasive particles.

8. The abrasive article of claim 1, wherein the particles have an average particle size within a range of at least 0.1 microns and not greater than 500 microns.

9. The abrasive article of claim 1, wherein the particles have an average particle size within a range of at least 2 microns to not greater than 40 microns.

10. The abrasive article of claim 1, wherein the particles have an average particles size less than an average thickness (tc) of the coating.

11. The abrasive article of claim 1, wherein the coating comprises an average thickness of at least 15 microns and not greater than 600 microns.

12. The abrasive article of claim 1, wherein the binder material of the coating is the same as the bond material.

13. An abrasive article comprising:

a body including:

abrasive particles contained within a bond material; and a first major surface, a second major surface opposite the first major surface, and a side surface extending between the first major surface and second major surface; and a coating overlying at least a portion of the first major surface and at least a portion of the second major surface of the body, wherein the coating comprises a cermet, a ceramic, or a combination thereof, wherein the cermet comprises at least one element selected from the group consisting of chromium, nickel, carbon, tungsten, sulfur, molybdenum, iron, zinc, silicon, titanium, aluminum, zirconium, magnesium, boron, cobalt, calcium, carbides, nitrides, or any combination thereof.

14. The abrasive article of claim 13, wherein the coating comprises the ceramic including chromium carbide.

15. The abrasive article of claim 13, wherein the coating comprises the cermet including nickel and chromium.

16. The abrasive article of claim 13, wherein the cermet comprises a multiphase material including a first phase comprising chromium carbide and a second phase comprising nickel chromium.

17. The abrasive article of claim 13, wherein the coating overlies all of the first major surface, all of the second major surface, or all of both the first and second major surfaces.

18. The abrasive article of claim 13, wherein the coating is bonded directly to the portion of the first major surface and the portion of the second major surface.

19. An abrasive article comprising:

a body including:

abrasive particles contained within a bond material; and a first major surface, a second major surface opposite the first major surface, and a side surface extending between the first major surface and second major surface; and a coating overlying at least a portion of the first major surface and at least a portion of the second major surface of the body, wherein the coating comprises a binder material and particles within the binder material, the particles comprising chromium carbide.

20. The abrasive article of claim 19, wherein the particles further comprise nickel.

* * * * *